US009147357B2

(12) United States Patent
Teranishi et al.

(10) Patent No.: US 9,147,357 B2
(45) Date of Patent: Sep. 29, 2015

(54) DISPLAY DEVICE AND ELECTRONIC APPARATUS

(71) Applicant: Japan Display Inc., Tokyo (JP)

(72) Inventors: Yasuyuki Teranishi, Tokyo (JP); Takayuki Nakanishi, Tokyo (JP); Masaya Tamaki, Tokyo (JP); Yoko Fukunaga, Tokyo (JP)

(73) Assignee: JAPAN DISPLAY INC, Tokyo (JP)

( * ) Notice: Subject to any disclaimer, the term of this patent is extended or adjusted under 35 U.S.C. 154(b) by 114 days.

(21) Appl. No.: 13/939,866

(22) Filed: Jul. 11, 2013

(65) Prior Publication Data

US 2014/0015866 A1 Jan. 16, 2014

(30) Foreign Application Priority Data

Jul. 12, 2012 (JP) ..... 2012-156980

(51) Int. Cl.
*G09G 3/20* (2006.01)
*G09G 3/36* (2006.01)

(52) U.S. Cl.
CPC ..... *G09G 3/2074* (2013.01); *G09G 3/2007* (2013.01); *G09G 3/3659* (2013.01); *G09G 3/3614* (2013.01); *G09G 2300/02* (2013.01); *G09G 2300/0439* (2013.01); *G09G 2300/0842* (2013.01); *G09G 2300/0857* (2013.01); *G09G 2300/0861* (2013.01); *G09G 2320/0204* (2013.01); *G09G 2320/0686* (2013.01)

(58) Field of Classification Search
CPC ..... G09G 3/2074
USPC ..... 345/87–104
See application file for complete search history.

(56) References Cited

U.S. PATENT DOCUMENTS

2002/0097208 A1* 7/2002 Hashimoto ..... 345/87
2003/0174116 A1* 9/2003 Maeda et al. ..... 345/98
2006/0158588 A1 7/2006 Uh et al.

(Continued)

FOREIGN PATENT DOCUMENTS

CN 1790139 6/2006
CN 102246222 11/2011

(Continued)

OTHER PUBLICATIONS

Office Action issued in connection with Japanese Patent Application No. 2012-156980, dated Aug. 4, 2015 (5 pages).

(Continued)

*Primary Examiner* — Kathy Wang-Hurst
*Assistant Examiner* — David Tung
(74) *Attorney, Agent, or Firm* — K&L Gates LLP

(57) ABSTRACT

According to an aspect, a display device includes a display panel and a plurality of memory circuits. The display panel includes a plurality of pixels each including a plurality of sub-pixel electrodes arranged in a matrix, and the display panel is divided into at least a first region and a second region in which at least one of the predetermined maximum number of displayable gradations and maximum resolution is different from that of the first region. The memory circuits are located under the sub-pixel electrodes and each of the memory circuits stores therein pixel potential corresponding to gradation to be applied to at least one of the sub-pixel electrodes. The arrangement of the sub-pixel electrodes is the same in the first region and the second region of the display panel.

9 Claims, 17 Drawing Sheets

(56) References Cited

U.S. PATENT DOCUMENTS

| | | | | |
|---|---|---|---|---|
| 2011/0242149 | A1 | 10/2011 | Yoshida et al. | |
| 2012/0162594 | A1 * | 6/2012 | Tamaki et al. | 349/139 |

FOREIGN PATENT DOCUMENTS

| | | |
|---|---|---|
| EP | 2466577 | 6/2012 |
| JP | 2002-268600 | 9/2002 |
| JP | 2004-191574 | 8/2004 |
| JP | 2008-076624 | 4/2008 |
| JP | 2009-204636 | 9/2009 |
| JP | 2011-215635 | 10/2011 |

OTHER PUBLICATIONS

Office Action issued in connection with Chinese Patent Application No. 201310294035.6, dated Jun. 18, 2015 (11 pages).

* cited by examiner

DISPLAY DEVICE AND ELECTRONIC APPARATUS

CROSS REFERENCES TO RELATED APPLICATIONS

The present application claims priority to Japanese Priority Patent Application JP 2012-156980 filed in the Japan Patent Office on Jul. 12, 2012, the entire content of which is hereby incorporated by reference.

BACKGROUND

1. Technical Field

The present disclosure relates to a display device including a liquid crystal layer. Further, the present disclosure relates to an electronic apparatus having the display device including the liquid crystal layer.

2. Description of the Related Art

In recent years, there has been a growing need for display devices used in mobile devices such as a cellular telephone and an electronic paper. Such a display device is required to secure a low production cost and the visibility of gradation display by performing gradation display suitable for the contents of display images. For example, Japanese Patent Application Laid-open Publication No. 2002-268600 (JP-A-2002-268600) discloses a technique for setting two or more kinds of portions having different maximum numbers of displayable gradations of data within one display screen.

For example, Japanese Patent Application Laid-open Publication No. 2008-076624 (JP-A-2008-076624) and Japanese Patent Application Laid-open Publication No. 2009-204636 (JP-A-2009-204636) disclose a technique in which each pixel in a display device includes a memory.

A display device for a mobile device is required to further reduce power consumption. With respect to memories in JP-A-2008-076624 and JP-A-2009-204636, when the total number of memories increases, electrical power for driving or maintaining the memories also increases. Accordingly, the total number of memories may be limited to reduce the power consumption.

However, if the number of memories is limited, performance may not reach that of processing the number of colors to be expressed or gradation display suitable for the contents of display images described in JP-A-2002-268600, resulting in low-resolution images.

For the foregoing reasons, there is a need for a display device that can achieve low power consumption while changing at least one of the maximum number of gradations and the pixel resolution that can be displayed between regions of the display panel, and an electronic apparatus having the display device.

SUMMARY

According to an aspect, a display device includes a display panel and a plurality of memory circuits. The display panel includes a plurality of pixels each including a plurality of sub-pixel electrodes arranged in a matrix, and the display panel is divided into at least a first region and a second region in which at least one of the predetermined maximum number of displayable gradations and maximum resolution is different from that of the first region. The memory circuits are located under the sub-pixel electrodes and each of the memory circuits stores therein pixel potential corresponding to gradation to be applied to at least one of the sub-pixel electrodes. The arrangement of the sub-pixel electrodes is the same in the first region and the second region of the display panel.

According to another aspect, an electronic apparatus includes a display device having a display panel and a plurality of memory circuits. A plurality of pixels each including a plurality of sub-pixel electrodes are arranged in a matrix in the display panel, and the display panel is divided into a plurality of regions including at least a first region and a second region in which at least one of the predetermined maximum number of displayable gradations and maximum resolution is different from that of the first region. The memory circuits are arranged in a lower layer of the sub-pixel electrodes and each store therein pixel potential corresponding to gradation to be applied to at least one of the sub-pixel electrodes. The arrangement of the sub-pixel electrodes is the same in the first region and the second region of the display panel.

Additional features and advantages are described herein, and will be apparent from the following Detailed Description and the figures.

DETAILED DESCRIPTION

Hereinafter, embodiments of the present disclosure will be described in detail with reference to accompanying drawings. Description will be performed in the order as follows.

1. Embodiments (Display Device)

1-1. First Embodiment 1-2. Second Embodiment 1-3. Third Embodiment

2. Application Example (Electronic Apparatus)

An example in which the display device according to the above embodiments is applied to electronic apparatus 1-1. First Embodiment

[Configuration]

Figure 1:
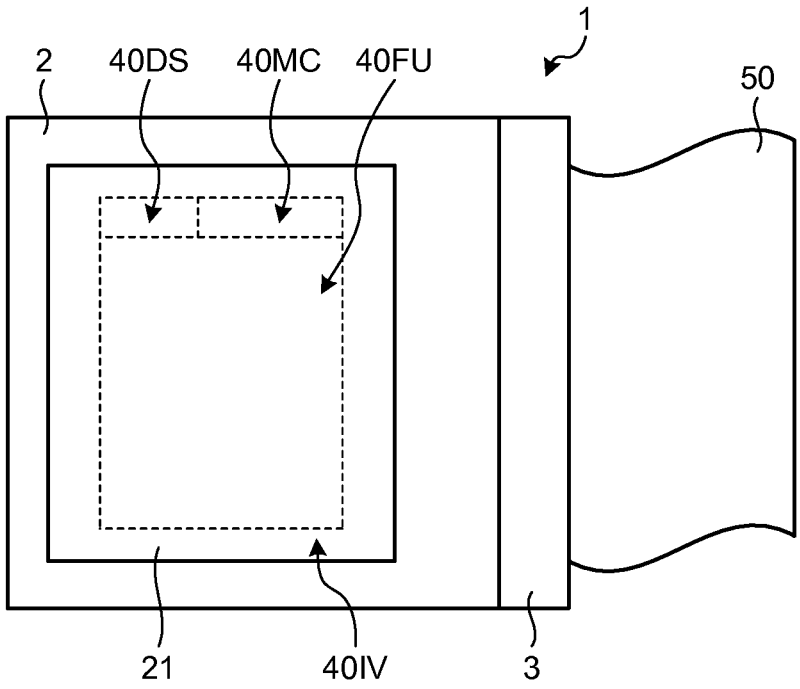
FIG. 1 is an explanatory diagram illustrating an example of the configuration of a display device according to a first embodiment of the present disclosure.

FIG. 1 is an explanatory diagram illustrating an example of the configuration of a display device according to a first embodiment of the present disclosure. FIG. 1 is a schematic view and does not necessarily represent an actual dimension and shape. A display device 1 corresponds to a specific example of a display device according to the present disclosure.

The display device 1 is a display device of reflection type or semi-transmissive type and includes a display panel 2 including a pixel array unit 21, a driver IC 3, and a flexible printed circuit (FPC) 50. The flexible printed circuit 50 transmits an external signal to the driver IC 3 or driving electric power for driving the driver IC 3. For example, as illustrated in FIG. 1, the pixel array unit 21 includes regions between which the number of displayable gradations differs, such as a color full-spec region 40FU that can display gradation of 6 bits, a color subtractive region 40DS that can display gradation of 3 bits, a monochrome region 40MC that can display gradation of 1 bit, and an inactive region 40IV that can display gradation of 0 bit.

(Example of System Configuration of Display Device)

Figure 2:
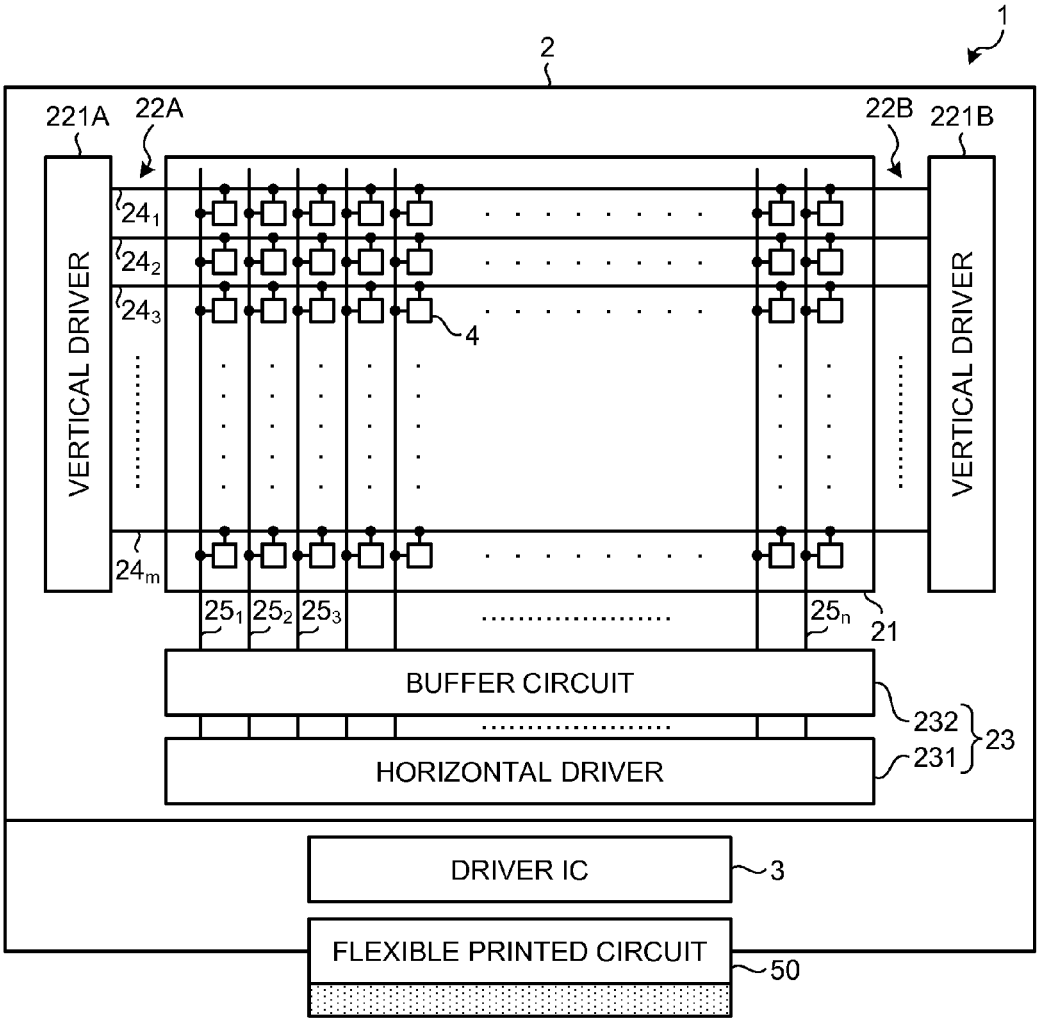
FIG. 2 is a block diagram illustrating an example of the system configuration of the display device in FIG. 1.

FIG. 2 is a block diagram illustrating an example of the system configuration of the display device in FIG. 1. The display panel 2 includes the pixel array unit 21, the driver IC 3 having function of an interface (I/F) and a timing generator, vertical drive circuits 22A and 22B, and a horizontal drive circuit 23 on a transparent substrate to be described later. The horizontal drive circuit 23 includes a horizontal driver 231 and a buffer circuit 232.

In the pixel array unit 21, pixels 4 including a liquid crystal layer to be described later are arranged in a matrix in which units each constituting one pixel on the display are arranged in m rows by n columns. In this specification, the row means a pixel row having n pixels 4 arranged in one direction. Also, the column means a pixel column having m pixels 4 arranged in a direction orthogonal to the direction along which the rows are arranged. The values of m and n are determined according to display resolution in the vertical direction and display resolution in the horizontal direction, respectively. In the pixel array unit 21, with respect to the array of m rows by n columns of pixels 4, scanning lines $\mathbf{24}_1$, $\mathbf{24}_2$, $\mathbf{24}_3$. . . $\mathbf{24}_m$ are wired for each of the rows and signal lines $\mathbf{25}_1$, $\mathbf{25}_2$, $\mathbf{25}_3$. . . $\mathbf{25}_n$ are wired for each of the columns. Hereinafter, in the embodiments, the scanning lines $\mathbf{24}_1$, $\mathbf{24}_2$, $\mathbf{24}_3$. . . $\mathbf{24}_m$ may be represented as the scanning line 24 and the signal lines $\mathbf{25}_1$, $\mathbf{25}_2$, $\mathbf{25}_3$. . . $\mathbf{25}_n$ may be represented as the signal line 25 in some cases.

To the display panel 2, a master clock, a horizontal synchronizing signal, and a vertical synchronizing signal as external signals are input from outside, and provided to the driver IC 3. The driver IC 3 performs level conversion (boosts the voltage) of a master clock, a horizontal synchronizing signal, and a vertical synchronizing signal at the voltage magnitude of external power supply into the voltage magnitude of an internal power supply required for driving a liquid crystal. The driver IC 3 then passes the level converted master clock, horizontal synchronizing signal, and vertical synchronizing signal through the timing generator as a master clock, a horizontal synchronizing signal, and a vertical synchronizing signal, respectively, and generates a vertical start pulse, a vertical clock pulse, a horizontal start pulse, and a horizontal clock pulse. The driver IC 3 provides the vertical start pulse and the vertical clock pulse to the vertical drive circuits 22A and 22B, and provides the horizontal start pulse and the horizontal clock pulse to the horizontal drive circuit 23. The driver IC 3 generates a common voltage (opposite electrode voltage) VCOM to be provided in common to the pixel electrodes of each of the pixels 4, and an in-phase control pulse FRP and an opposite-phase control pulse XFRP of the common voltage VCOM, and provides them to the pixel array unit 21.

The vertical drive circuits 22A and 22B sandwiches the pixel array unit 21. The vertical drive circuits 22A and 22B may be arranged close to one side of the pixel array unit 21. The vertical drive circuits 22A and 22B include vertical drivers 221A and 221B including shift registers and the like, etc., respectively. In the vertical drive circuits 22A and 22B, when the vertical start pulse is provided as described above, the vertical drivers 221A and 221B sequentially output vertical scanning pulses in synchronization with the vertical clock pulse, and provide them to each of the scanning lines $\mathbf{24}_1$, $\mathbf{24}_2$, $\mathbf{24}_3$. . . $\mathbf{24}_m$ of the pixel array unit 21 to sequentially select the pixels 4 line by line.

Digital image data, such as R (red), G (green), and B (blue) data of 6 bits is provided to the horizontal drive circuit 23. The horizontal drive circuit 23 writes the display data via the signal line 25 to each of the pixels 4 in the row selected by vertical scanning performed by the vertical drive circuits 22A and 22B per each pixel, per a plurality of pixels, or for all the pixels at once.

(Cross-Sectional Configuration of Display Panel)

Figure 3:
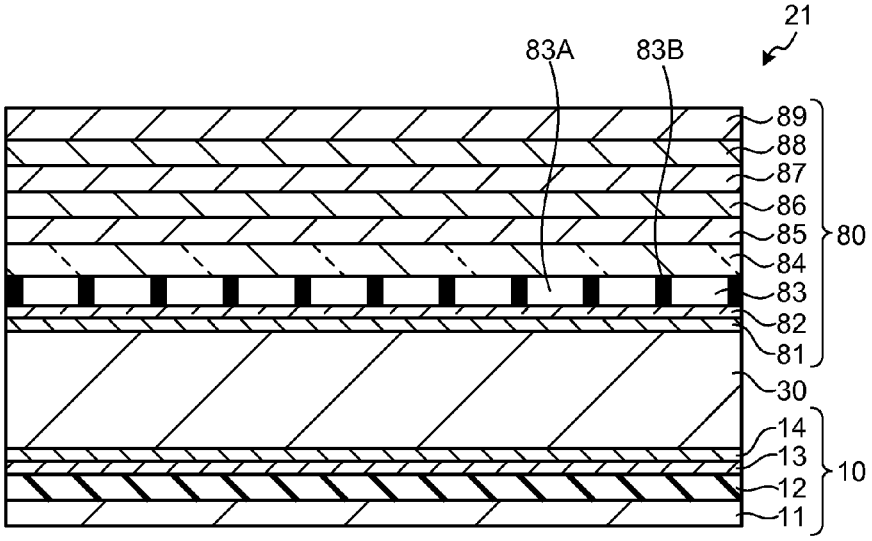
FIG. 3 is a cross-sectional view illustrating an example of the cross-sectional configuration of the display panel of the display device in FIG. 1.
Figure 4:
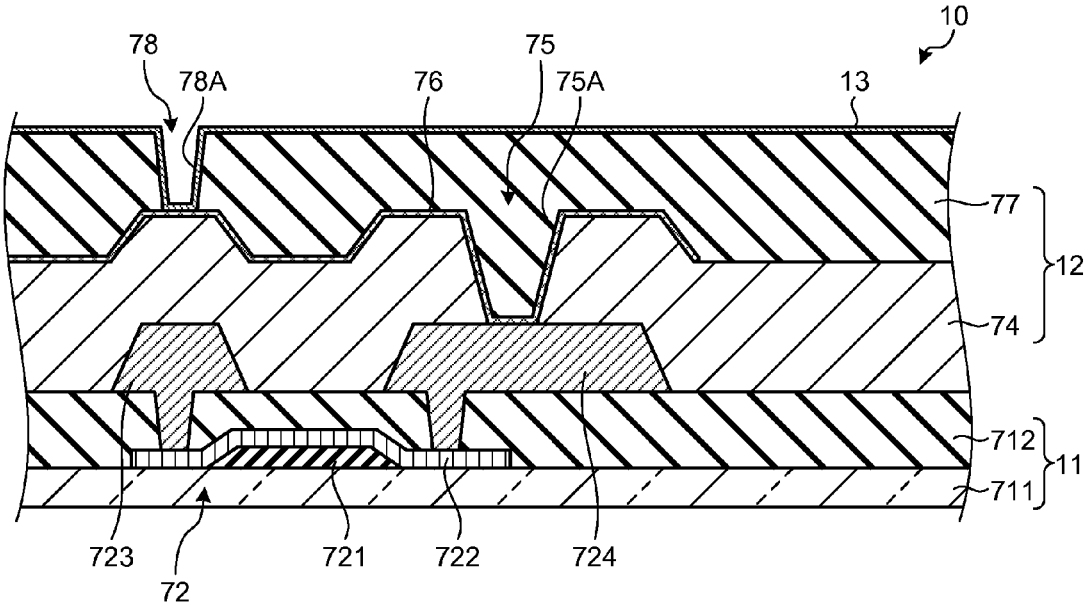
FIG. 4 is a cross-sectional view illustrating an example of the configuration of a lower substrate of the display device in FIG. 1.

FIG. 3 is a cross-sectional view illustrating an example of the cross-sectional configuration of the display panel of the display device in FIG. 1. FIG. 4 is a cross-sectional view illustrating an example of the configuration of a lower substrate of the display device in FIG. 1. FIGS. 3 and 4 are schematic views and do not necessarily represent actual dimension and shape. For example, as illustrated in FIG. 3, the display panel includes a lower substrate 10, an upper substrate 80, a liquid crystal layer 30 sandwiched between the lower substrate 10 and the upper substrate 80, and a drive circuit to be described later for driving the lower substrate 10.

In the display device 1 illustrated in FIG. 1, the top surface of the upper substrate 80 (for example, a polarizing plate 89 to be described later) is an image display surface, and a light source such as a backlight is not arranged at the back of the lower substrate 10. That is, the display device 1 is a display device of a reflection type that displays images by reflecting light entering from the image display surface side.

(Liquid Crystal Layer 30)

For example, the liquid crystal layer 30 includes a nematic liquid crystal. The liquid crystal layer 30 is driven in response to a video signal, and has a modulation function to transmit or block the light incident on the liquid crystal layer 30 per each pixel through application of a voltage corresponding to the video signal.

(Lower Substrate 10)

For example, as illustrated in FIG. 3, the lower substrate 10 includes a drive substrate 11 on which a thin film transistor (TFT) and the like are formed, an insulating layer 12 that covers the TFT and the like, a reflecting electrode layer 13 electrically connected with the TFT and the like, and an orientation layer 14 formed on the top surface of the reflecting electrode layer 13. The reflecting electrode layer 13 corresponds to a specific example of a plurality of pixel electrodes according to the present disclosure.

As illustrated in FIG. 4, for example, the drive substrate 11 includes a pixel drive circuit 72 including a TFT, a capacitative element, and the like on a transparent substrate 711 constituted by a glass substrate or the like. The transparent substrate 711 may be constituted by a material other than the glass substrate, such as a translucent resin substrate, quartz, and a silicon substrate. The pixel drive circuit 72 includes a gate electrode 721, bump electrode layers 723 and 724 functioning as a source electrode or a drain electrode, formed of a metal such as gold, aluminum, copper, or alloy thereof, and a semiconductor layer 722 including the TFT, the capacitative element, and the like. The semiconductor layer 722 is covered by an insulating film 712 and connected to the gate electrode 721 and the bump electrode layers 723 and 724.

As illustrated in FIG. 4, the bump electrode layers 723 and 724 have a thickness of e.g. 500 nm to 1000 nm and protrude from the insulating film 712. The bump electrode layers 723 and 724 are covered by a first planarization layer 74 and a second planarization layer 77 to reduce an influence of a difference in height due to thickness of the bump electrode layers 723 and 724. A contact hole 75A as a first contact part 75 is formed in the first planarization layer 74. A relay wiring layer 76 is constituted by a translucent electrically conducting material such as indium tin oxide (ITO). The relay wiring layer 76 and the bump electrode layer 724 are electrically connected to each other via the contact hole 75A of the first contact part 75. For example, the relay wiring layer 76 has a thickness of e.g. 50 nm to 100 nm.

As illustrated in FIG. 3, the reflecting electrode layer 13 works together with a transparent electrode layer 82 to be described later on the upper substrate 80 side to drive the liquid crystal layer 30. For example, the reflecting electrode layer 13 includes a plurality of pixel electrodes two-dimensionally arranged in plane. When voltage is applied by the drive circuit, the reflecting electrode layer 13 (pixel electrodes) and the transparent electrode layer 82 generate between them an electric field corresponding to a potential difference between them, and drive the liquid crystal layer 30 according to the magnitude of the electric field. In the display device 1, a portion thereof, corresponding to a portion at which the reflecting electrode layer 13 (pixel electrodes) and the transparent electrode layer 82 are opposed to each other, forms a basic unit by which the liquid crystal layer 30 is partially driven by the voltage applied between the reflecting electrode layer 13 (pixel electrodes) and the transparent electrode layer 82. The basic unit corresponds to a pixel. The reflecting electrode layer 13 also has a function as a reflective layer that reflects ambient light entering through the liquid crystal layer 30, to the liquid crystal layer 30 side. The reflecting electrode layer 13 is formed of an electrically conducting material that reflects visible light, for example, a metallic material such as silver (Ag). A surface of the reflecting electrode layer 13 is a mirror plane, for example.

As illustrated in FIG. 4, the reflecting electrode layer 13 is arranged on the second planarization layer 77, where a contact hole 78A as a second contact part 78 is formed. The relay wiring layer 76 and the reflecting electrode layer 13 are electrically connected to each other via the contact hole 78A of the second contact part 78.

As illustrated in FIG. 3, the orientation layer 14 orients liquid crystal molecules in the liquid crystal layer 30 in a predetermined direction, and directly contacts with the liquid crystal layer 30. For example, the orientation layer 14 is formed of a high polymer material such as polyimide, and is formed by performing a rubbing process on applied polyimide or the like, for example.

(Upper Substrate 80)

As illustrated in FIG. 3, the upper substrate 80 includes an orientation layer 81, the transparent electrode layer 82, a color filter (CF) layer 83, and a transparent substrate 84 in this order from the liquid crystal layer 30 side.

The orientation layer 81 orients liquid crystal molecules in the liquid crystal layer 30 in a predetermined direction, and directly contacts with the liquid crystal layer 30. For example, the orientation layer 81 is formed of a high polymer material such as polyimide, and is formed by performing a rubbing process on applied polyimide or the like, for example.

The transparent electrode layer 82 is arranged to face the pixel electrodes, and is a sheet electrode formed on the entire in-plane area, for example. The transparent electrode layer 82 has a function as a common electrode for each of the pixels because it is arranged to face the pixel electrodes. The transparent electrode layer 82 is formed of an electrically conducting material translucent to ambient light, such as ITO.

The CF layer 83 has a color filter 83A in a region opposed to the pixel electrode, and has a light-shielding film 83B in a region not opposed to the pixel electrode. The color filter 83A is formed such that color filters for performing color separation on light passing through the liquid crystal layer 30 into, for example, the three primary colors of red, green, and blue are arranged corresponding to the pixels. For example, the light-shielding film 83B has a function to absorb visible light. The light-shielding film 83B is formed between regions corresponding to the pixels. The transparent substrate 84 is formed of a substrate transparent to ambient light, such as a glass substrate.

For example, the upper substrate 80 includes a light diffusion layer 85, a light diffusion layer 86, a ¼λ plate 87, a ½λ plate 88, and the polarizing plate 89 on the top surface of the transparent substrate 84 in this order from the liquid crystal layer 30 side. The light diffusion layer 85, the light diffusion layer 86, the ¼λ plate 87, the ½λ plate 88, and the polarizing plate 89 are joined to their adjacent layers via adhesive layers or glue layers, for example. The ¼λ plate 87 and the ½λ plate 88 are retardation layers of the present disclosure.

The light diffusion layers 85 and 86 are forward scattering layers having large forward scattering and less back scattering. The light diffusion layers 85 and 86 are anisotropic scattering layers for scattering light entering from a specific direction. When light enters from a specific direction on the polarizing plate 89 side with respect to the upper substrate 80, the light diffusion layers 85 and 86 transmit the incident light with little scattering, and largely scatter the returning light reflected by the reflecting electrode layer 13.

For example, the ¼λ plate 87 is a uniaxial oriented resin film. For example, the retardation thereof is 0.14 μm and corresponds to about ¼ of the green light wavelength that has the highest luminosity factor among the visible light. Accordingly, the ¼λ plate 87 has a function to convert linearly polarized light entering from the polarizing plate 89 side into circularly polarized light. For example, the ½λ plate 88 is a uniaxial oriented resin film. For example, the retardation thereof is 0.27 μm and corresponds to about ½ of the green light wavelength that has the highest luminosity factor among the visible light. The ¼λ plate 87 and the ½λ plate 88 as a whole have a function to convert the linearly polarized light entering from the polarizing plate 89 side into circularly polarized light, and function as a (wide-band) circularly polarizing plate for a wide range of wavelengths. The polarizing plate 89 has a function to absorb a predetermined linearly polarized component and transmit the other polarized components. Accordingly, the polarizing plate 89 has a function to convert outside light entering from outside into linearly polarized light.

(Drive System of Liquid Crystal Display Panel)

The display device 1 may be deteriorated in the specific resistance (the resistance value specific to a substance) and the like of a liquid crystal by continuous application of DC voltage having a particular polarity to the liquid crystal layer 30. In the display device 1, a drive system for inverting the polarity of a video signal at predetermined intervals based on the common voltage VCOM is adopted in order to prevent the deterioration of the specific resistance (the resistance value specific to a substance) and the like of the liquid crystal.

As the drive system for a liquid crystal display panel, drive systems such as a line inversion, a dot inversion, and a frame inversion are known. The line inversion is a drive system for inverting the polarity of the video signal at time intervals of one H (H is a horizontal time period) corresponding to one line (1 pixel row). The dot inversion is a drive system for alternately inverting the polarity of the video signal for every other adjacent pixel. The frame inversion is a drive system for inverting the video signal applied to all the pixels per each frame corresponding to one screen at once with the same polarity.

The display device 1 may adopt any of the above-described drive systems. Preferably, the display device 1 adopts the drive system of the frame inversion rather than the drive system of the line inversion or the dot inversion. In a case of the line inversion or the dot inversion in which electric potential is different between two adjacent pixels, liquid crystal orientation between the pixels may not be stably controlled.

Accordingly, in the display device 1, a residual image may remain in a space between the pixels where liquid crystal orientation is not stabilized.

In contrast, in a case of the frame inversion, electric potential between the transparent electrode layer 82 and the reflecting electrode layer 13 is the same between two adjacent pixels. Therefore, the liquid crystal molecules behave similarly in the vicinity of each of the pair of pixels. As a result, the liquid crystal orientation between the pixels is stabilized as compared with the case of the line inversion or the dot inversion.

As described above, in a case of the frame inversion in which the electric potential is the same between the two adjacent pixels, the liquid crystal orientation between the pixels may be relatively stably controlled. Therefore, the risk of a residual image being generated decreases even if display is performed using the space between the pixels as a display region.

(MIP System)

Figure 5:
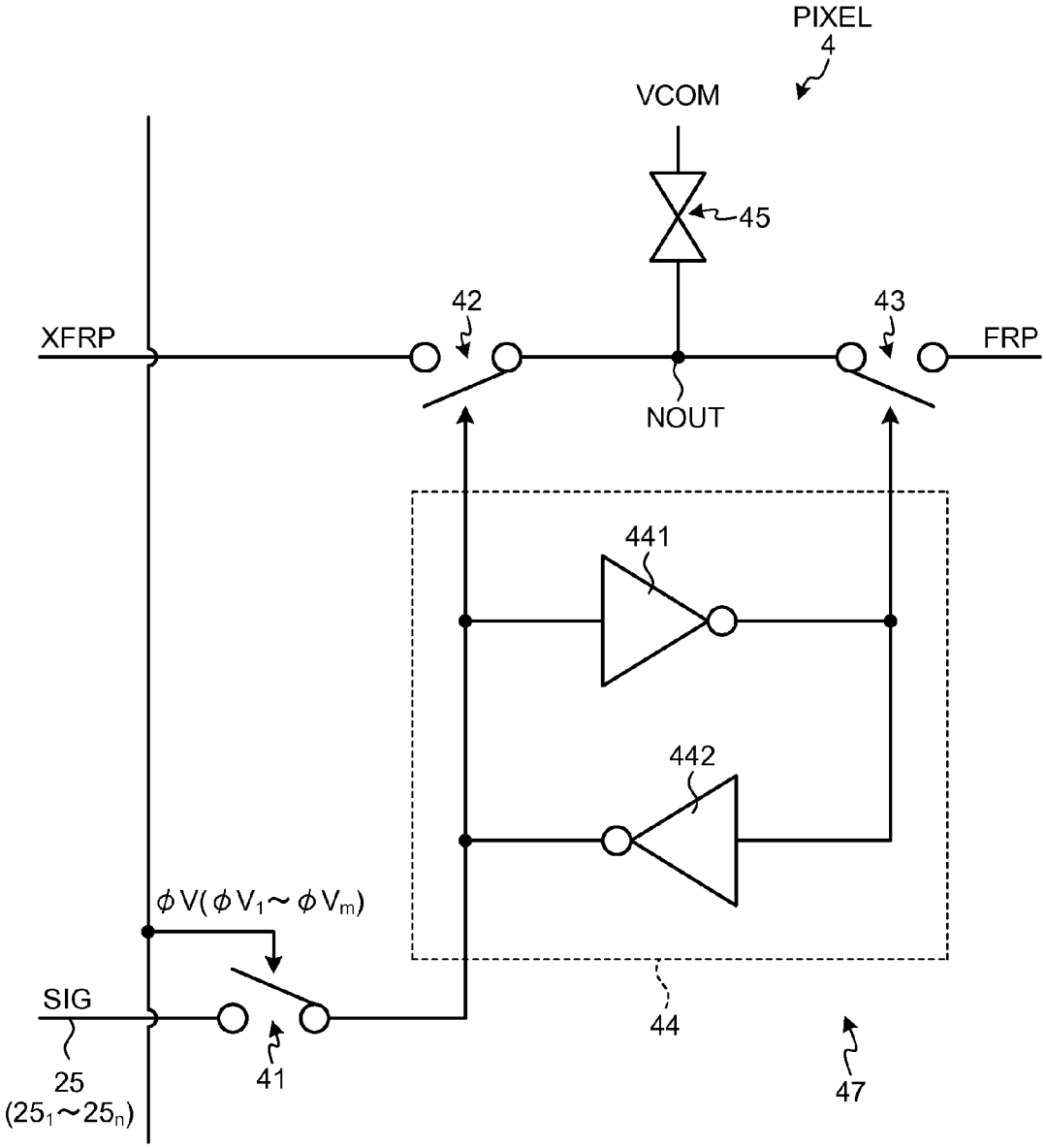
FIG. 5 is a circuit diagram illustrating an example of a drive circuit that drives a pixel.
Figure 6:
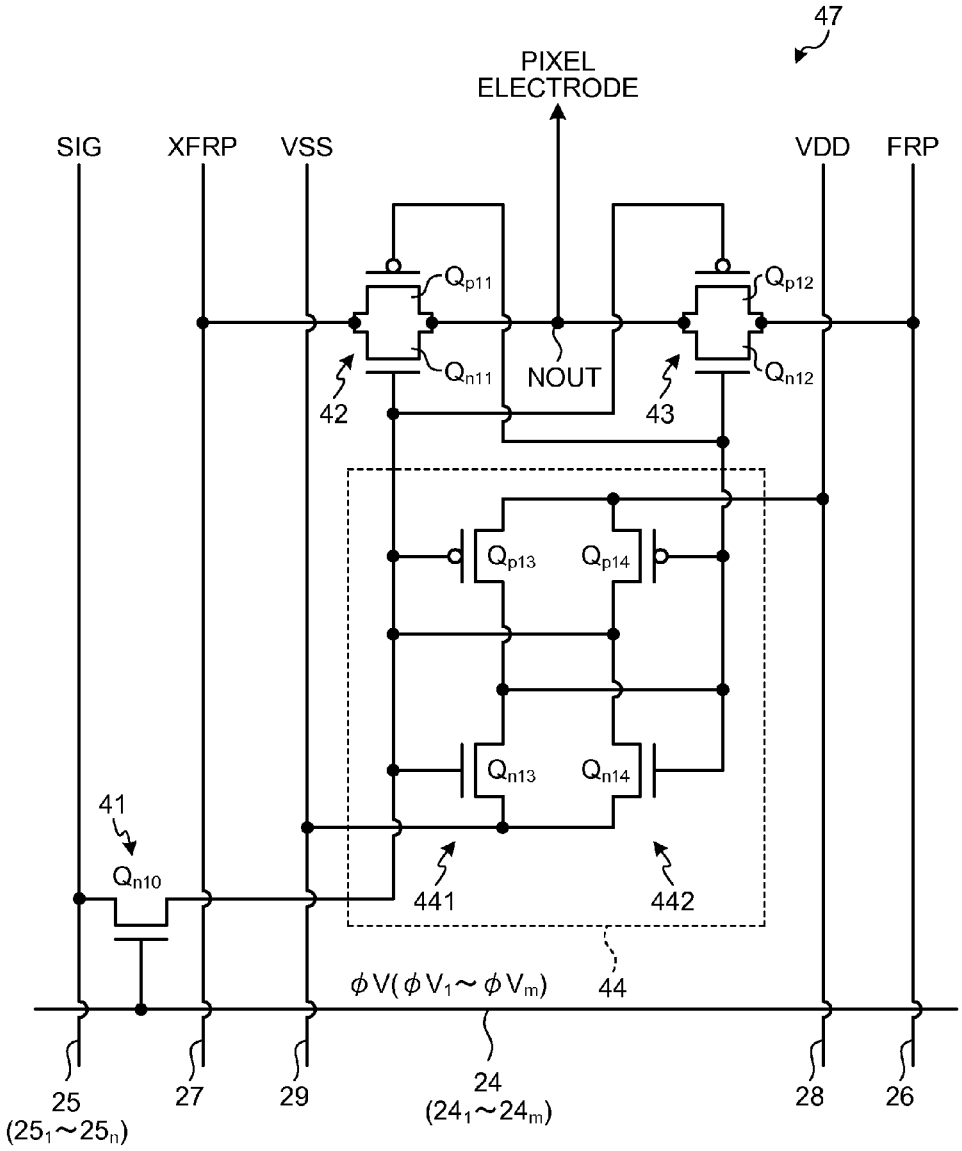
FIG. 6 is a circuit diagram illustrating an example of the drive circuit that drives a pixel.
Figure 7:
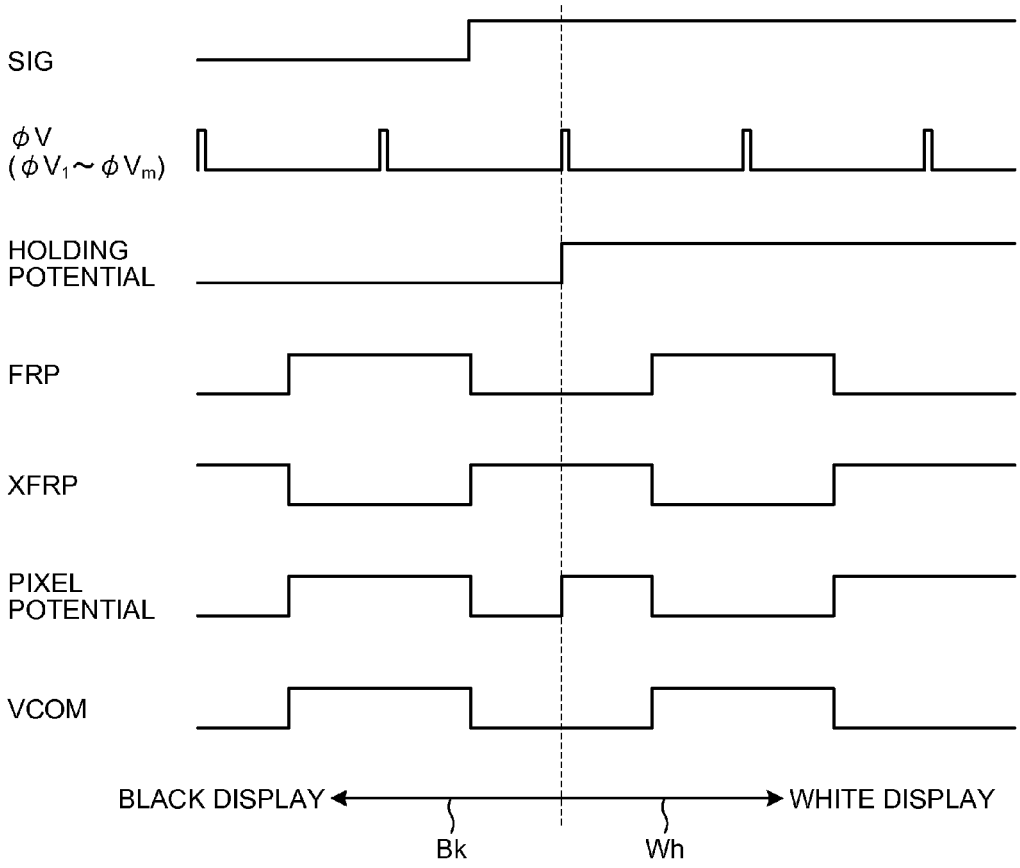
FIG. 7 is an explanatory diagram illustrating an example of a drive waveform in the display device of FIG. 1.

FIGS. 5 and 6 are circuit diagrams illustrating an example of a drive circuit that drives a pixel. FIG. 7 is an explanatory diagram illustrating an example of a drive waveform in the display device of FIG. 1. When the drive system of the frame inversion is used in the display device 1, shading may be generated because signal voltages having the same polarity are applied to a signal line over one frame period. Therefore, in using the drive system of frame inversion, the display device 1 adopts a memory circuit having a memory function for each region in which the pixel(s) 4 is arranged, such as what is called an MIP (Memory In Pixel) system having a memory that can store therein data for each pixel 4. In a case of the MIP system, shading can be suppressed because a certain voltage is always applied to the pixel 4.

Further, the MIP system performs display in an analog display mode and display in a memory display mode, by including a memory circuit 47 that stores therein data in a region where the pixel 4 is arranged. The analog display mode is a display mode in which the display device 1 displays the gradation of the pixel 4 in an analog fashion. The memory display mode is a display mode in which the display device 1 digitally displays the gradation of the pixel 4 on the basis of binary information (logic "1"/logic "0") stored in the memory circuit in the pixel 4.

In a case of the memory display mode, the writing operation of a signal potential reflecting the gradation does not need to be performed with a frame cycle because information held in the memory circuit is used. Accordingly, power consumption in the memory display mode is smaller than a case of the analog display mode in which the writing operation of the signal potential reflecting the gradation should be performed with a frame cycle. Therefore, the power consumption of the display device 1 is low.

As illustrated in FIG. 5, the pixel 4 includes a circuit with a static random access memory (SRAM) function including three switch elements 41, 42, and 43, and a latch part 44, in addition to a liquid crystal cell 45. This circuit is formed on the semiconductor layer 722 of the pixel drive circuit 72 illustrated in FIG. 4. As illustrated in FIG. 3, the liquid crystal cell 45 refers to liquid crystal capacity generated in the liquid crystal layer 30 between the reflecting electrode layer (pixel electrode) 13 and the transparent electrode layer 82 arranged to be opposed to the reflecting electrode layer (pixel electrode) 13.

The switch element 41 is connected to the signal line 25 at one end thereof. When the scanning signal ϕV is provided from the vertical drive circuits 22A and 22B illustrated in FIG. 2, the switch element 41 becomes the "ON" (closed) state and takes in data SIG supplied from the horizontal drive circuit 23 illustrated in FIG. 2 via the signal line 25. The latch part 44 is constituted by inverters 441 and 442 oppositely connected in parallel, and holds (latches) electric potential corresponding to the data SIG taken in by the switch element 41.

For example, as illustrated in FIG. 6, the inverter 441 includes an N channel MOS (hereinafter, referred to as an NMOS) transistor $Q_{n13}$ and a P channel MOS (hereinafter, referred to as a PMOS) transistor $Q_{p13}$ in which gates and drains of the NMOS transistor $Q_{n13}$ and PMOS transistor $Q_{p13}$ are connected in common. The inverter 442 includes an NMOS transistor $Q_{n14}$ and a PMOS transistor $Q_{p14}$ in which gates and drains of the NMOS transistor $Q_{n14}$ and PMOS transistor $Q_{p14}$ are connected in common.

The inverter 441 and the inverter 442 are arranged in parallel between a voltage VDD of a positive-side power supply line 28 and a voltage VSS of a negative-side power supply line 29, and are connected in a loop to form an SRAM configuration memory.

As illustrated in FIG. 6, the switch element 41 is a switching circuit including an NMOS transistor $Q_{n10}$ and supplying the signal level of the data SIG by connecting the signal line 25 to the inverters 441 and 442. The switch element 42 is a switching circuit including an NMOS transistor $Q_{n11}$ and a PMOS transistor $Q_{p11}$, which is turned on and off by output from the inverter 442, and applies the control pulse XFRP having an opposite phase to the common voltage VCOM to the pixel electrode of the liquid crystal cell 45 from a signal line 27 via the latch part 44. The switch element 43 is a switching circuit including an NMOS transistor $Q_{n12}$ and a PMOS transistor $Q_{P12}$, which is turned on and off by output from the inverter 441, and applies the control pulse R phase with the common voltage VCOM to the pixel electrode of the liquid crystal cell 45 from a signal line 26 via the latch part 44.

As described above, the control pulse XFRP in opposite phase to the common voltage VCOM is provided to one terminal of the switch element 42. The control pulse FRP in phase with the common voltage VCOM is provided to one terminal of the switch element 43. The other terminals of the switch elements 42 and 43 are connected in common, and the common connection node thereof is an output node NOUT of the pixel circuit. Any one of the switch elements 42 and 43 becomes the "ON" state according to the polarity of a holding potential of the latch part 44. Accordingly, with respect to the transparent electrode layer 82 to which the common voltage VCOM is applied and the liquid crystal capacity of the liquid crystal cell 45, the control pulse FRP or the control pulse XFRP is applied to the reflecting electrode layer 13.

For example, when the holding potential of the latch part 44 has negative polarity, black display is performed because the pixel potential of the liquid crystal capacity of the liquid crystal cell 45 is in phase with the common voltage VCOM. In contrast, when the holding potential of the latch part 44 has positive polarity, white display is performed because the pixel potential of the liquid crystal capacity of the liquid crystal cell 45 is in opposite phase to the common voltage VCOM. As illustrated in FIG. 7, when the electric potential of the data SIG in the signal line 25 is switched, the switch element 41 turns to the "ON" (closed) state to take in the data SIG upon receiving the scanning signal ϕV. The latch part 44 maintains (latches) a holding potential corresponding to the data SIG taken in by the switch element 41. The pixel potential applied to the reflecting electrode layer 13 is switched from being in phase to being in opposite phase with respect to the common voltage VCOM, and the pixel may be switched from black display Bk to white display Wh. In this way, the pixel array unit 21 of the display device 1 according to the first embodiment is in the display mode of a normally black type. Alternatively, the pixel array unit 21 may be in the display mode of a normally white type. As described above, the display mode of the liquid crystal may be classified into two modes: a normally white mode in which white display is performed when no electric field (voltage) is applied and black display is performed when electric field is applied; and a normally black mode in which the black display is performed when no electric field is applied and the white display is performed when electric field is applied.

As described above, in the memory display mode, shading can be suppressed because a certain voltage is always applied to the pixel 4. Although a case where the SRAM is used as a memory incorporated in the pixel 4 is described as an example in the first embodiment, the SRAM is merely an example and a memory having another configuration may be adopted, such as a configuration using a dynamic random access memory (DRAM).

(Area Coverage Modulation Method)

As described above, two-gradation expression is performed with 1 bit for each pixel in the memory display mode. An area coverage modulation method is used to increase the number of gradations expressed by each pixel. The area coverage modulation method is a gradation expression system for expressing, for example, four gradations with 2 bits by assigning the weight of 2:1 to a pixel area (an area of the pixel electrode).

Specifically, the reflecting electrode layer 13 as a reflective display region of the pixel 4 is divided into a plurality of pixel (sub-pixel) electrodes weighted by area. The display device 1 applies a pixel potential selected according to the holding potential of the latch part 44 to the pixel electrode weighted by area, and performs gradation display according to a combination of weighted areas.

The area coverage modulation method is a gradation expression system for expressing $2^N$ gradations by N sub-pixel electrodes weighted by area ratios of $2^0, 2^1, 2^2, \ldots, 2^{N-1}$ (N is an integer). For example, the area coverage modulation method is adopted for the purpose of improving the non-uniformity of image quality due to variation in TFT characteristics, and the like. In the display device 1 according to the first embodiment, four gradations are expressed by 2 bits by assigning the weight of 2:1 to an area (pixel area) of the reflecting electrode layer 13 as a pixel electrode.

Figure 8:
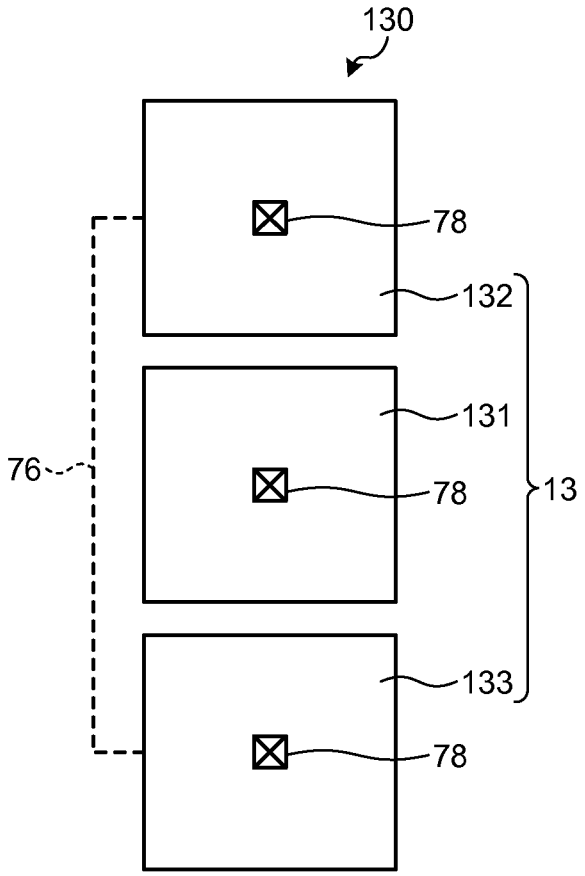
FIG. 8 is a plan view illustrating an example of the configuration of a pixel electrode in the display device of FIG. 1.

FIG. 8 is a plan view illustrating an example of the configuration of the pixel electrode in the display device of FIG. 1. As illustrated in FIG. 8, in a sub-pixel electrode 130, three partial electrodes 132, 131, and 133 having the same area are arranged in a line for the pixel. The partial electrode 132 and the partial electrode 133 are electrically connected via the relay wiring layer 76 and function as one pixel. Therefore, the weight of 2:1 is assigned to the total area of the partial electrodes 132 and 133 and the area of the partial electrode 131. The sub-pixel electrode 130 has the excellent balance of gradation expression because the barycenter of the sub-pixel electrode 130 is aligned with the barycenter of gradation.

Figure 9:
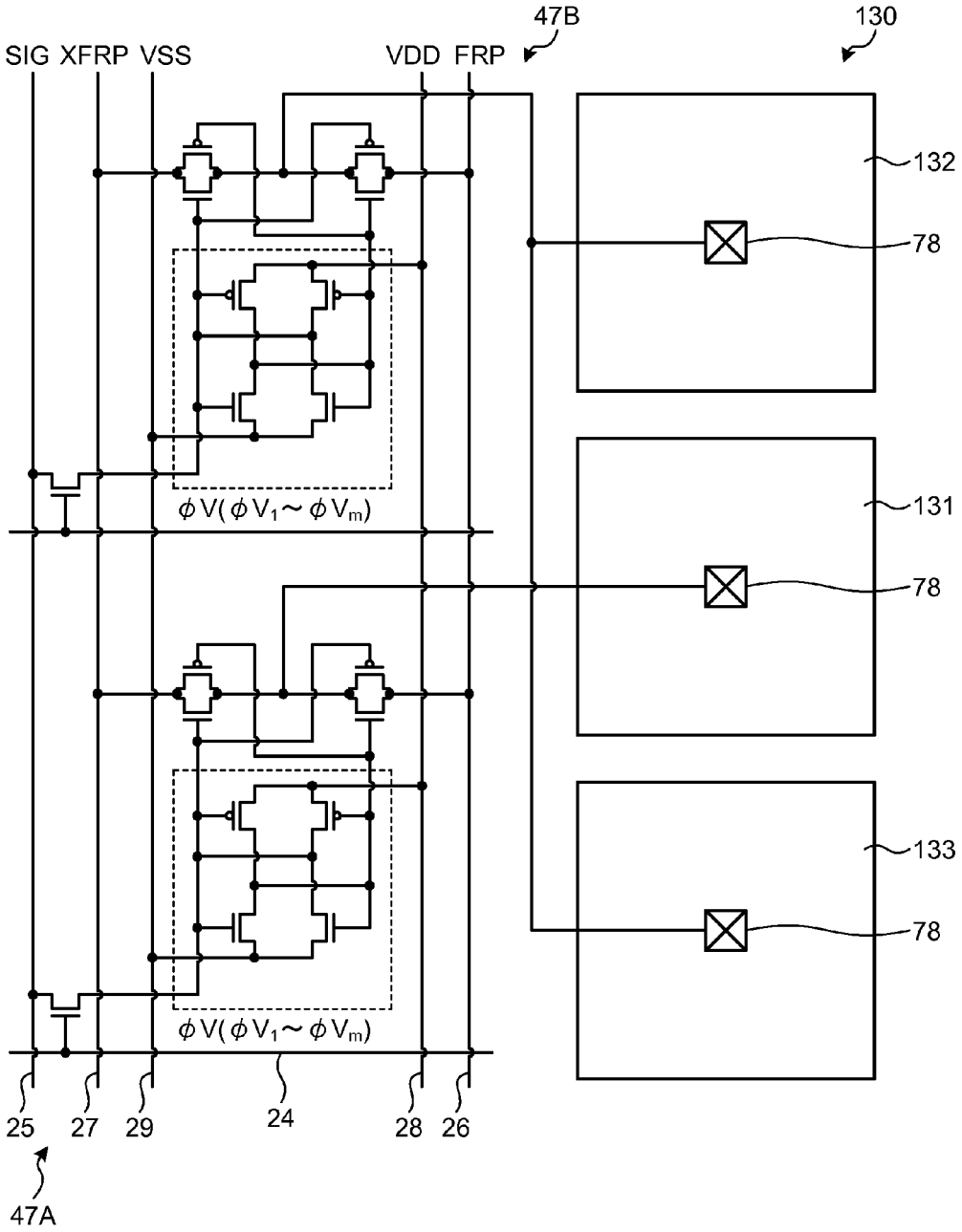
FIG. 9 is an explanatory diagram illustrating a connection state between a memory circuit illustrated in FIG. 6 and the pixel electrode illustrated in FIG. 8.

FIG. 9 is an explanatory diagram illustrating a connection state between the memory circuit illustrated in FIG. 6 and the pixel electrode illustrated in FIG. 8. As illustrated in FIG. 9, memory circuits 47A and 47B same as the memory circuit 47 illustrated in FIG. 6 are connected to the partial electrode 131, and the partial electrode 132 and the partial electrode 133, respectively. The memory circuit 47A drives the partial electrode 131, and the memory circuit 47B drives the partial electrode 132 and the partial electrode 133 at the same time. As described above, the sub-pixel electrode 130 includes two pixel electrodes and is driven by memory circuits of which number is equal to the number of pixel electrodes.

Figure 10:
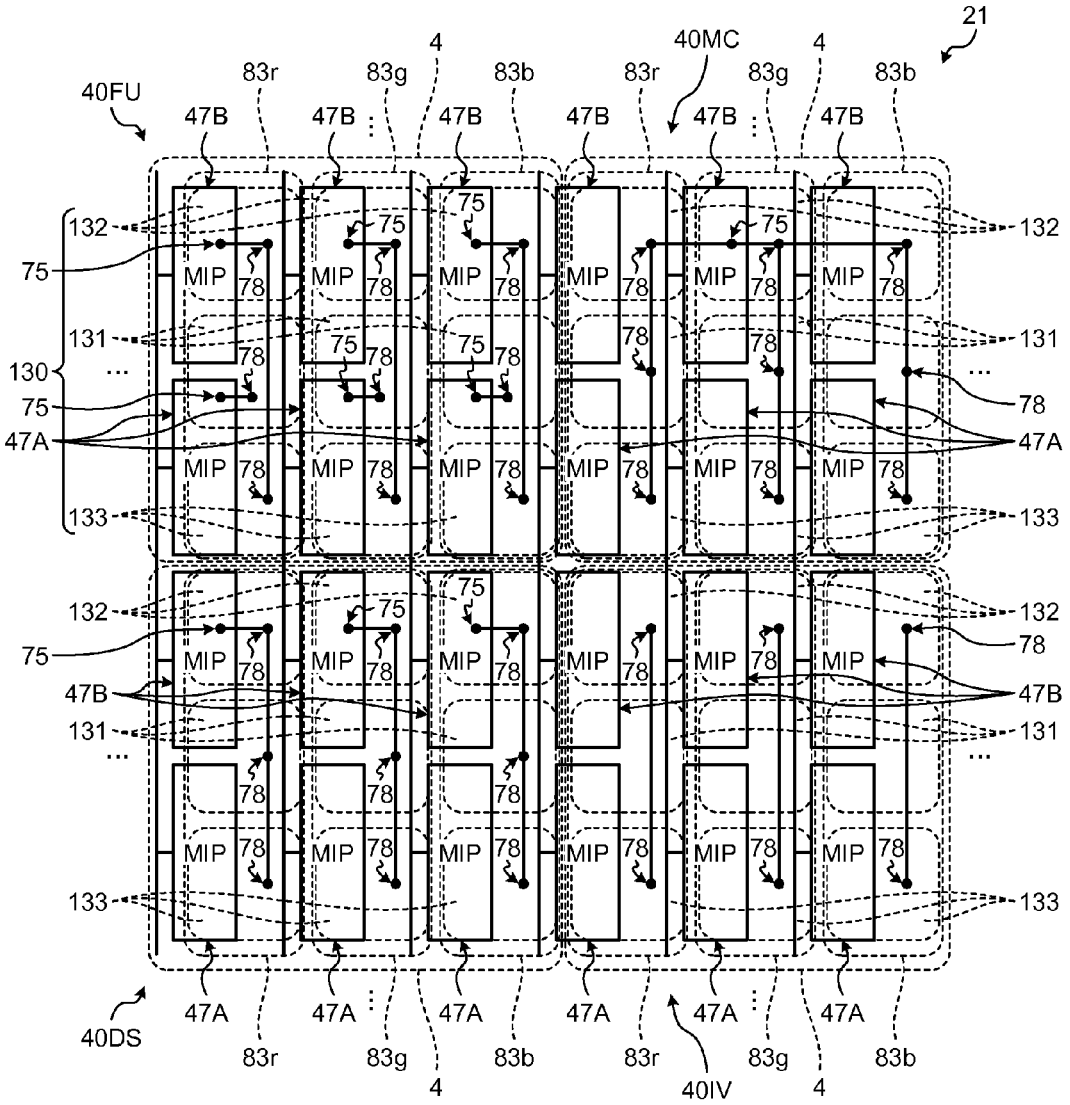
FIG. 10 is a diagram illustrating an example of a display panel in which drive electrodes and pixel electrodes are arranged.

FIG. 10 is a diagram illustrating an example of a display panel in which drive electrodes and pixel electrodes are arranged. As illustrated in FIG. 10, in the pixel 4, the sub-pixel electrodes 130 including the three partial electrodes 132, 131, and 133 are arranged in a line, and a red color filter 83*r*, a green color filter 83*g*, and a blue color filter 83*b* for performing color separation into the three primary colors of red, green, and blue of the CF layer 83 are arranged corresponding to the sub-pixel electrodes 130. In a region occupied by the pixel 4, memory circuits of which number is equal to the number of pixel electrodes included in the sub-pixel electrode 130 are arranged at different lamination positions corresponding to the partial electrodes 132, 131, and 133.

The pixel array unit 21 includes regions between which the number of displayable gradations differs, such as the color full-spec region 40FU that can display gradation of 6 bits, the color subtractive region 40DS that can display gradation of 3 bits, the monochrome region 40MC that can display gradation of 1 bit, and the inactive region 40IV that can display gradation of 0 bit. The color full-spec region 40FU can display 64 gradations in stages. The color subtractive region 40DS can display eight gradations in stages. The monochrome region 40MC can display two gradations. The inactive region 40IV remains black in the display mode of a normally black type as described above, and remains white in the display mode of a normally white type.

In the pixel array unit 21, the arrangement of the partial electrodes 131, 132, and 133 of the pixel 4 is the same in the color full-spec region 40FU, the color subtractive region 40DS, the monochrome region 40MC, and the inactive region 40IV. In addition, in the pixel array unit 21, the number of the memory circuits 47A and 47B arranged for each of the pixels 4 is also the same in the color full-spec region 40FU, the color subtractive region 40DS, the monochrome region 40MC, and the inactive region 40IV. As described above, the number of the memory circuits 47A and 47B is the number of memory circuits in the color full-spec region 40FU, which is a region that can display the maximum number of gradations among the regions (the color full-spec region 40FU, the color subtractive region 40DS, the monochrome region 40MC, and the inactive region 40IV).

In the sub-pixel electrode 130 of the color full-spec region 40FU, the memory circuit 47A drives the partial electrode 131, and the memory circuit 47B drives the partial electrode 132 and the partial electrode 133 at the same time. In the sub-pixel electrode 130 of the color subtractive region 40DS, the memory circuit 47A is not connected to the partial electrode 131, the partial electrode 132, or the partial electrode 133, and the memory circuit 47B drives the partial electrode 131, the partial electrode 132, and the partial electrode 133 at the same time.

In the pixel 4 of the color subtractive region 40DS, the three memory circuits 47A are not connected to the partial electrode 131, the partial electrode 132, or the partial electrode 133. Therefore, the three memory circuits 47B drive all of the partial electrode 131, the partial electrode 132, and the partial electrode 133 in the three lines of sub-pixel electrodes 130 at the same time. The display device 1 according to the first embodiment can display gradations of 3 bits when the three memory circuits 47B control one of the three lines of the sub-pixel electrodes 130 corresponding to the red color filter 83*r*, the green color filter 83*g*, or the blue color filter 83*b*, respectively.

In the pixel 4 of the monochrome region 40MC, the three memory circuits 47A and two of the three memory circuits 47B are not connected to the partial electrode 131, the partial electrode 132, or the partial electrode 133, and the other memory circuit 47B drives the partial electrodes 131, the partial electrodes 132, and the partial electrodes 133 at the same time. The display device 1 according to the first embodiment is a normally black display type, and performs white display when the memory circuit 47B turns on the three lines of sub-pixel electrodes 130 corresponding to the red color filter 83*r*, the green color filter 83*g*, and the blue color filter 83*b* at the same time. That is, the pixel 4 of the monochrome region 40MC can display gradation of 1 bit.

In the pixel 4 of the inactive region 40IV, the three memory circuits 47A and the three memory circuits 47B are not connected to the partial electrode 131, the partial electrode 132, or the partial electrode 133. In addition, the partial electrode 131, the partial electrode 132, and the partial electrode 133 are not driven and in an inactive state. The display device 1 according to the first embodiment is a normally black display type, and the pixel 4 of the inactive region 40IV performs black display in this case. In the pixel 4 of the inactive region 40IV, the three memory circuits 47A and the three memory circuits 47B are not connected to the partial electrode 131, the partial electrode 132, or the partial electrode 133. White display may be performed by supplying the partial electrode 131, the partial electrode 132, and the partial electrode 133 with electric potential independently of pixel potential held by the three memory circuits 47A and the three memory circuits 47B.

(Modification)

Figure 11:
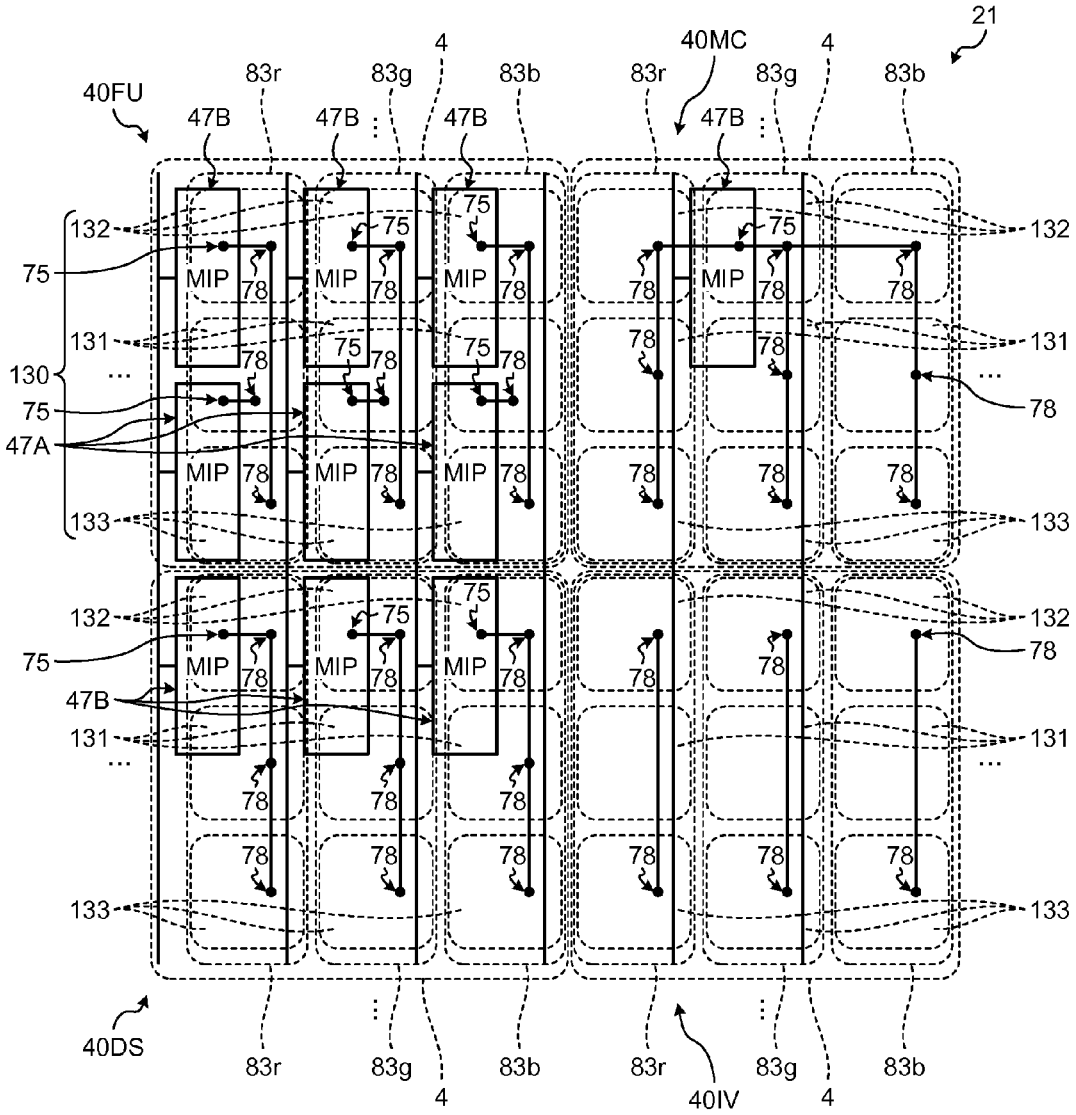
FIG. 11 is a diagram illustrating a modification of the display panel in which the drive electrodes and the pixel electrodes are arranged.

FIG. 11 is a diagram illustrating a modification of the display panel in which the drive electrode and the pixel electrode are arranged. Similarly to the pixel array unit 21 illustrated in FIG. 10, the pixel array unit 21 illustrated in FIG. 11 includes regions between which the number of displayable gradations differs, such as the color full-spec region 40FU that can display gradation of 6 bits, the color subtractive region 40DS that can display gradation of 3 bits, the monochrome region 40MC that can display gradation of 1 bit, and the inactive region 40IV that can display gradation of 0 bit.

In the pixel array unit 21, the arrangement of the partial electrodes of the pixel 4 is the same in the color full-spec region 40FU, the color subtractive region 40DS, the monochrome region 40MC, and the inactive region 40IV.

However, in the pixel array unit 21, the numbers of the memory circuits 47A and 47B arranged for each of the pixels 4 are different between the color full-spec region 40FU, the color subtractive region 40DS, the monochrome region 40MC, and the inactive region 40IV. In the pixel array unit 21, only the memory circuits 47A and 47B to be driven are left in the color full-spec region 40FU, the color subtractive region 40DS, the monochrome region 40MC, and the inactive region 40IV. Accordingly, production cost of the memory circuits 47A and 47B can be reduced.

[Operation and Effect]

The operation and effect of the display device 1 according to the first embodiment will be described.

For example, as illustrated in FIG. 3, ambient light entering from a certain direction is converted into linearly polarized light by the polarizing plate 89, further converted into circularly polarized light by the ½λ plate 88 and the ¼λ plate 87, and is then incident on the liquid crystal layer 30. The light incident on the liquid crystal layer 30 is modulated according to a video signal in the liquid crystal layer 30 and reflected by the reflecting electrode layer 13. The light reflected by the reflecting electrode layer 13 is converted into linearly polarized light by the ¼λ plate 87 and the ½λ plate 88, and transmitted through the polarizing plate 89 to be ejected to the outside as image light.

The pixel drive circuit 72 and the bump electrode layers 723 and 724 illustrated in FIG. 4 constitute at least part of the memory circuits 47A and 47B, and have a large thickness. Therefore, the state of the insulating layer 12 (planarization layers 74 and 77) in the lamination direction may vary across the plane of the lower substrate 10 between places where laminated on the pixel drive circuit 72 and the bump electrode layers 723 and 724 while the memory circuits 47A and 47B to be driven are left, and where laminated on the drive substrate 11 while the memory circuits 47A and 47B are omitted. The variation of the insulating layer 12 (planarization layers 74 and 77) in the lamination direction across the plane of the lower substrate 10 is transferred to the deposition state of the reflecting electrode layer 13. This affects light reflected by the partial electrodes 132, 131, and 133 constituting the pixel 4 in the color full-spec region 40FU, the color subtractive region 40DS, the monochrome region 40MC, and the inactive region 40IV.

In the pixel array unit 21 illustrated in FIG. 10, the variation of the insulating layer 12 (planarization layers 74 and 77) in the lamination direction across the plane of the lower substrate 10 is reduced as compared with that in the pixel array unit 21 illustrated in FIG. 11. In the pixel array unit 21 illustrated in FIG. 10, this reduces the difference in the state of the ambient light reflected by the reflecting electrode layer 13 between the color full-spec region 40FU, the color subtractive region 40DS, the monochrome region 40MC, and the inactive region 40IV. Accordingly, the pixel array unit 21 illustrated in FIG. 10 can perform higher-quality display than the pixel array unit 21 illustrated in FIG. 11.

As illustrated in FIG. 4, the memory circuits 47A and 47B illustrated in FIG. 10 may be electrically connected with any of the three partial electrodes 132, 131, and 133 via the first contact part 75 and the second contact part 78. When the memory circuits 47A and 47B illustrated in FIG. 10 are not electrically connected with any of the three partial electrodes 132, 131, and 133, the memory circuits 47A and 47B do not have the relay wiring layer 76 at any one or more of the contact hole 75A of the first contact part 75 and the contact hole 78A of the second contact part 78. The thickness of the reflecting electrode layer 13 is not easily affected whether the relay wiring layer 76 at the contact hole 78A is formed or not. Accordingly, in the pixel array unit 21, this reduces the difference in the state of the ambient light reflected by the reflecting electrode layer 13 between the color full-spec region 40FU, the color subtractive region 40DS, the monochrome region 40MC, and the inactive region 40IV. Alternatively, when the memory circuits 47A and 47B illustrated in FIG. 10 are not electrically connected with any of the three partial electrodes 132, 131, and 133, the memory circuits 47A and 47B illustrated in FIG. 10 do not have a deposited pattern of the relay wiring layer 76 and not perform conduction. The reflecting electrode layer 13 can reduce the variation in thickness due to the relay wiring layer 76 because the thickness of the relay wiring layer 76 is smaller than the thicknesses of the pixel drive circuit 72 and the bump electrode layers 723 and 724 illustrated in FIG. 4.

The color full-spec region 40FU can perform display without limiting the number of memories in the memory circuit. The color full-spec region 40FU has high performance and can process display of colors or gradations suitable for the contents of a display image. In the color subtractive region 40DS and the monochrome region 40MC, the memory circuits 47A and 47B that are not electrically connected with any of the three partial electrodes 132, 131, and 133 do not consume electric power for driving or maintaining the memory, thereby reducing the power consumption in the pixel array unit 21. Also in the inactive region 40IV, the memory circuits 47A and 47B that are not electrically connected with the sub-pixel electrode 130 reduce the power consumption for driving or maintaining the memory. As described above, the display device 1 achieves low power consumption while changing at least one of the maximum number of gradations and the pixel resolution that can be displayed between regions of the display panel 2.

As described above, the sub-pixel electrode 130 includes the partial electrodes 132, 131, and 133, and the memory circuits 47A and 47B are arranged corresponding to the partial electrodes 132, 131, and 133. The numbers of the memory circuits arranged corresponding to the sub-pixel electrode 130 are the same between one region (a first region) and another region (a second region) among the color full-spec region 40FU, the color subtractive region 40DS, the monochrome region 40MC, and the inactive region 40IV. When the first region is the color full-spec region 40FU, the second region may be any of the color subtractive region 40DS, the monochrome region 40MC, and the inactive region 40IV. The number of the memory circuits 47A and 47B arranged corresponding to the sub-pixel electrode 130 is the number of the memory circuits in a region that can display the maximum number of gradations. Therefore, even when the layout is changed to the layout having a region with a different number of displayable gradations, the display panel 2 can optionally and easily change the configuration and range of the region by changing connection state between the sub-pixel electrode 130 and the memory circuits 47A and 47B.

Figure 12:
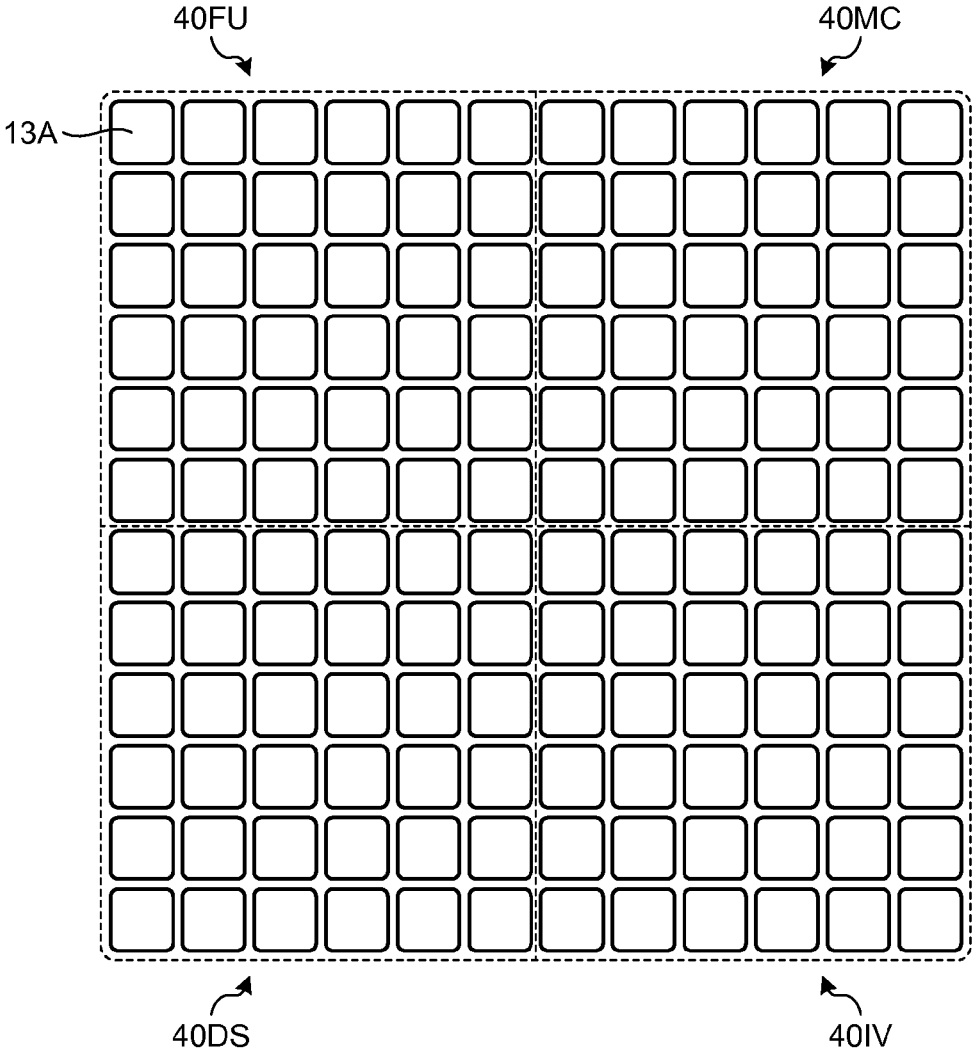
FIG. 12 is a plan view illustrating an example of the arrangement of the pixel electrodes in the display panel of the display device in FIG. 1.
Figure 13:
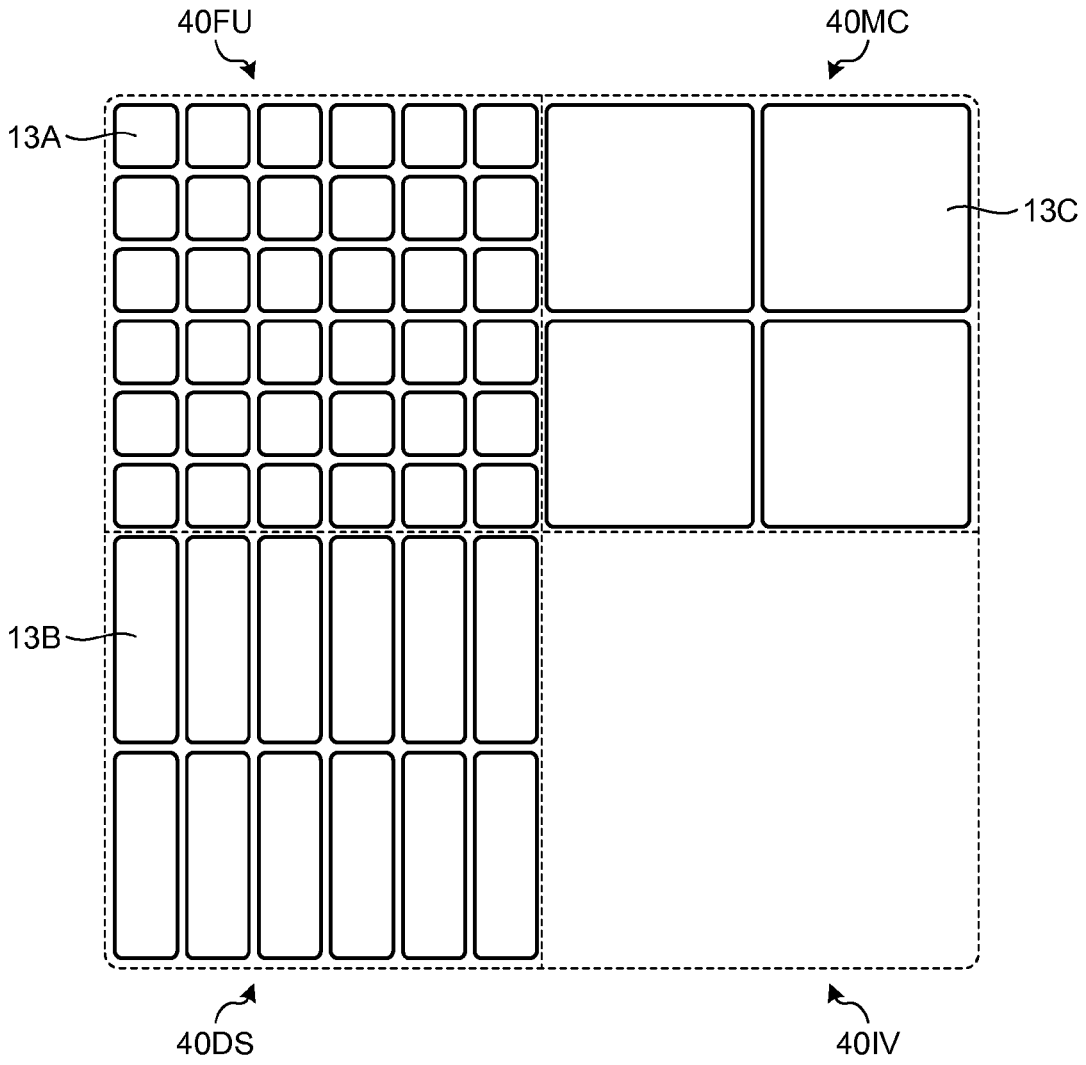
FIG. 13 is a plan view illustrating a comparative example of the arrangement of the pixel electrodes in the display panel.

FIG. 12 is a plan view illustrating an example of the arrangement of the pixel electrodes in the display panel of the display device in FIG. 1. FIG. 13 is a plan view illustrating a comparative example of the arrangement of the pixel electrodes in the display panel. As illustrated in FIG. 12, a partial electrode 13A is any of the partial electrodes 132, 131, and 133 illustrated in FIG. 10. According to the arrangement of the partial electrodes 13A illustrated in FIG. 12, the partial electrodes 13A having the same area are arranged in a matrix structure in the color full-spec region 40FU, the color subtractive region 40DS, the monochrome region 40MC, and the inactive region 40IV.

As illustrated in FIG. 13, it may be considered to arrange the partial electrode 13A, a partial electrode 13B, and a partial electrode 13C respectively having areas corresponding to the gradations of the color full-spec region 40FU, the color subtractive region 40DS, and the monochrome region 40MC. In this case, the partial electrode may not be arranged in the inactive region 40IV. The displayable gradations in the color full-spec region 40FU, the color subtractive region 40DS, the monochrome region 40MC, and the inactive region 40IV are same in FIG. 12 and in FIG. 13. However, the state of reflecting the ambient light is different among the partial electrode 13A, the partial electrode 13B, and the partial electrode 13C, and a region without the partial electrode in the color full-spec region 40FU, the color subtractive region 40DS, the monochrome region 40MC, and the inactive region 40IV. This may enhance the edges of the color full-spec region 40FU, the color subtractive region 40DS, the monochrome region 40MC, and the inactive region 40IV.

In contrast, as illustrated in FIG. 12, the sub-pixel electrodes 130, which is the partial electrodes 13A, is arranged in the same way in the color full-spec region 40FU, the color subtractive region 40DS, the monochrome region 40MC, and the inactive region 40IV. This reduces difference in reflection state of the ambient light in the plane of the display panel, and the risk of enhancing the edges of the color full-spec region 40FU, the color subtractive region 40DS, the monochrome region 40MC, and the inactive region 40IV.

1-2. Second Embodiment

[Configuration]

Figure 14:
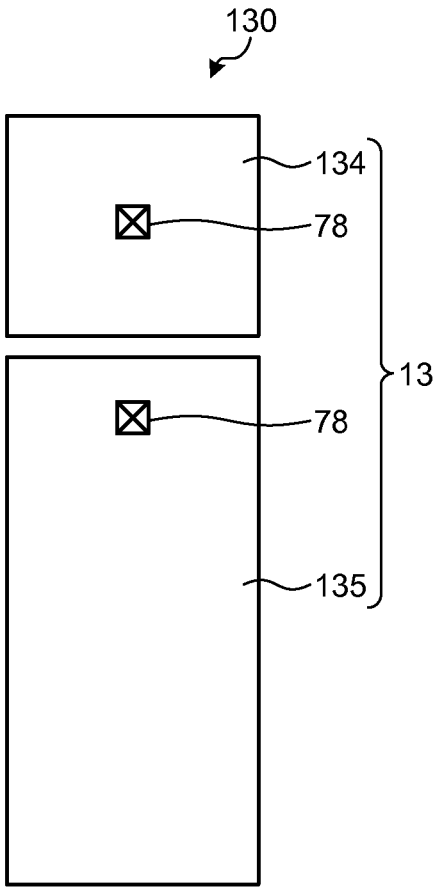
FIG. 14 is a plan view illustrating an example of the configuration of a pixel electrode in a display device according to a second embodiment of the present disclosure.

FIG. 14 is a plan view illustrating an example of the configuration of a pixel electrode in a display device according to a second embodiment of the present disclosure. The same components described in the first embodiment are denoted by the same reference numerals and the description thereof may not be repeated here.

In the memory display mode, two-gradation expression is performed with 1 bit for each pixel. In addition, the area coverage modulation method is used to increase gradations to be expressed in each pixel. As illustrated in FIG. 14, the sub-pixel electrode 130 is configured such that a partial electrode 134 with a relatively small area and a partial electrode 135 with a relatively large area are arranged in parallel. The area ratio between the partial electrode 134 and the partial electrode 135 is 1:2.

Figure 15:
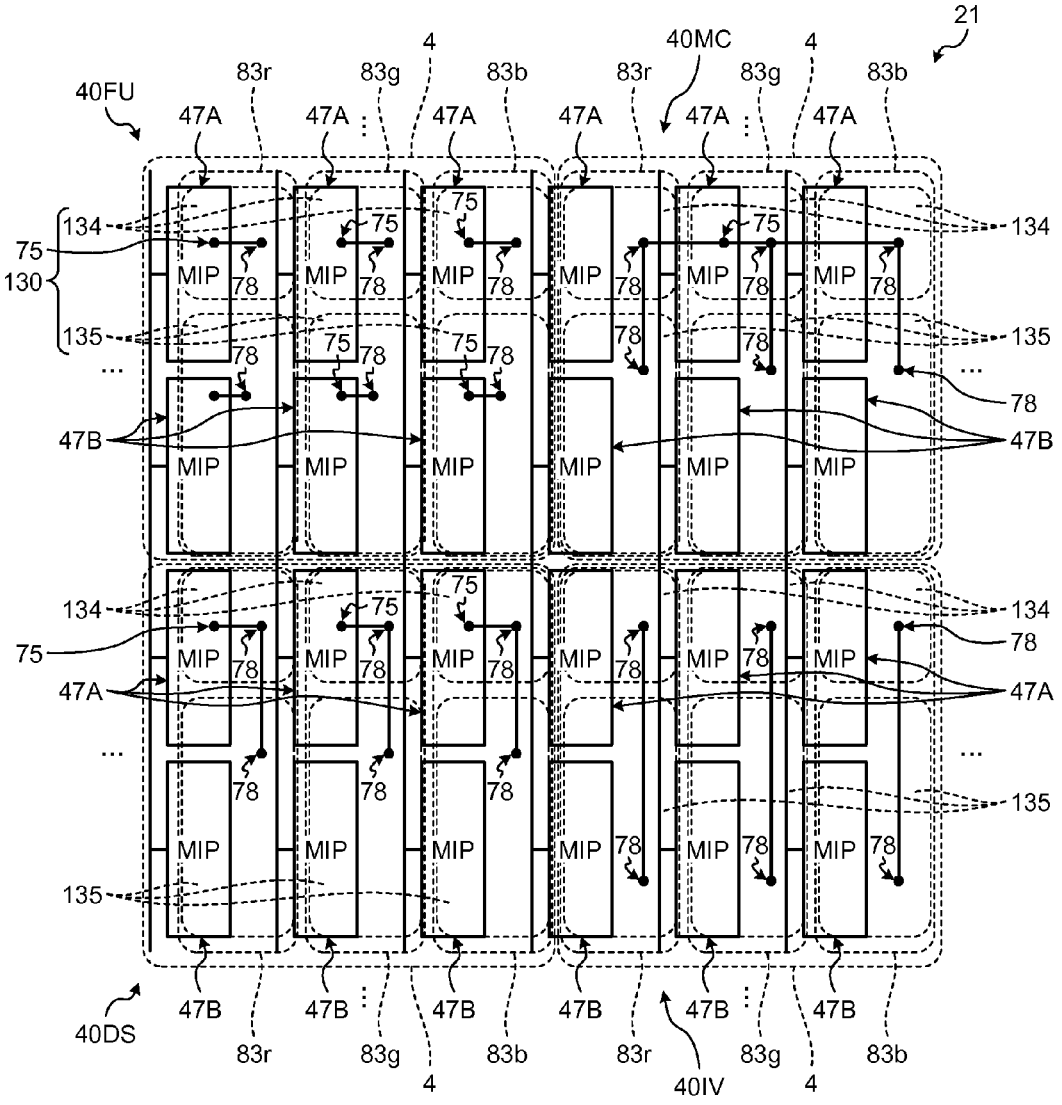
FIG. 15 is a diagram illustrating an example of a display panel in which drive electrodes and pixel electrodes are arranged.

FIG. 15 is a diagram illustrating an example of a display panel in which the drive electrodes and the pixel electrodes are arranged. As illustrated in FIG. 15, the memory circuits 47A and 47B are connected to the partial electrode 134 and the partial electrode 135, respectively. The memory circuit 47A drives the partial electrode 134, and the memory circuit 47B drives the partial electrode 135. As described above, the sub-pixel electrode 130 includes two pixel electrodes and is driven by the memory circuits of which number is equal to the number of the pixel electrodes. In this way, in the region occupied by the pixel 4, the memory circuits 47A and 47B of which number is equal to the number of the pixel electrodes included in the sub-pixel electrode 130 are arranged at lamination positions different from those of the partial electrodes 134 and 135.

[Operation and Effect]

The operation and effect of the display device 1 according to the second embodiment will be described. As illustrated in FIG. 15, the sub-pixel electrodes 130 are arranged in the same way in the color full-spec region 40FU, the color subtractive region 40DS, the monochrome region 40MC, and the inactive region 40IV. This reduces the difference in reflection state of the ambient light in the plane of the display panel, and the risk of enhancing the edges of the color full-spec region 40FU, the color subtractive region 40DS, the monochrome region 40MC, and the inactive region 40IV.

(Modification)

Figure 16:
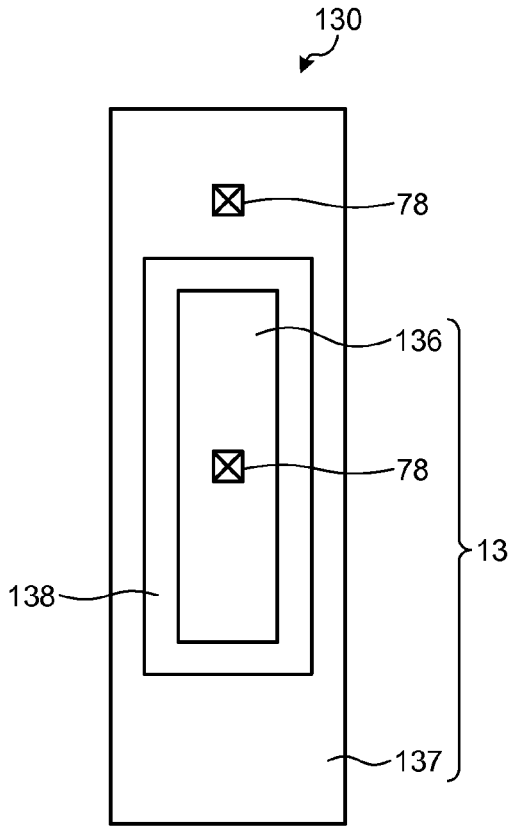
FIG. 16 is a plan view illustrating a modification of the configuration of the pixel electrode in the display device according to the second embodiment of the present disclosure.

FIG. 16 is a plan view illustrating a modification of the configuration of the pixel electrode in the display device according to the second embodiment of the present disclosure. As illustrated in FIG. 16, the sub-pixel electrode 130 may be constituted by a partial electrode 137 having an opening 138 and a partial electrode 136 arranged within the opening 138 of the partial electrode 137. Similarly to FIG. 15, the sub-pixel electrodes 130 according to the present modification are arranged in the same way in the color full-spec region 40FU, the color subtractive region 40DS, the monochrome region 40MC, and the inactive region 40IV. The memory circuit 47A drives the partial electrode 136, and the memory circuit 47B drives the partial electrode 137. As described above, the sub-pixel electrode 130 includes two pixel electrodes and is driven by the memory circuits 47A and 47B of which number is equal to the number of the pixel electrodes. In this way, in the region occupied by the pixel 4, the memory circuits 47A and 47B of which number is equal to the number of the pixel electrodes included in the sub-pixel electrode 130 are arranged at lamination positions different from those of the partial electrodes 136 and 137. The sub-pixel electrodes 130 are arranged in the same way in the color full-spec region 40FU, the color subtractive region 40DS, the monochrome region 40MC, and the inactive region 40IV. This reduces the difference in reflection state of the ambient light in the plane of the display panel, and the risk of enhancing the edges of the color full-spec region 40FU, the color subtractive region 40DS, the monochrome region 40MC, and the inactive region 40IV.

1-3. Third Embodiment

[Configuration]

Figure 17:
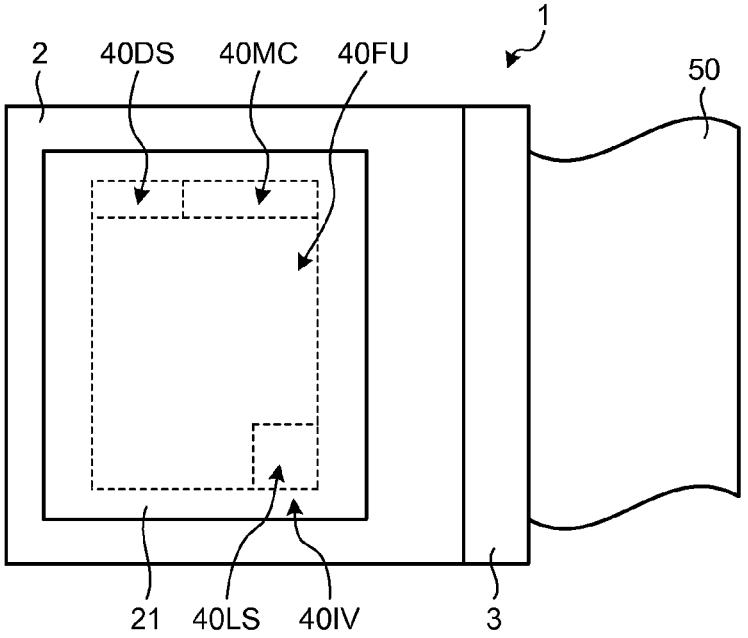
FIG. 17 is an explanatory diagram illustrating an example of the configuration of a display device according to a third embodiment of the present disclosure.

FIG. 17 is an explanatory diagram illustrating an example of the configuration of a display device according to a third embodiment of the present disclosure. FIG. 17 is a schematic view and does not necessarily represent actual dimension and shape. The display device 1 corresponds to a specific example of the display device according to the present disclosure. The same components described in the first embodiment are denoted by the same reference numerals and the description thereof may not be repeated here.

The display device 1 is a display device of reflection type or semi-transmissive type and includes a display panel 2 including the pixel array unit 21, the driver IC 3, and the flexible printed circuit (FPC) 50. For example, as illustrated in FIG. 17, the pixel array unit 21 includes regions between which the number of displayable gradations differs, such as the color full-spec region 40FU that can display gradation of 6 bits, the color subtractive region 40DS that can display gradation of 3 bits, the monochrome region 40MC that can display gradation of 1 bit, the inactive region 40IV that can display gradation of 0 bit, and the low-resolution region 40LS that can display gradation of 6 bits and has lower resolution than that of the color full-spec region 40FU.

Figure 18:
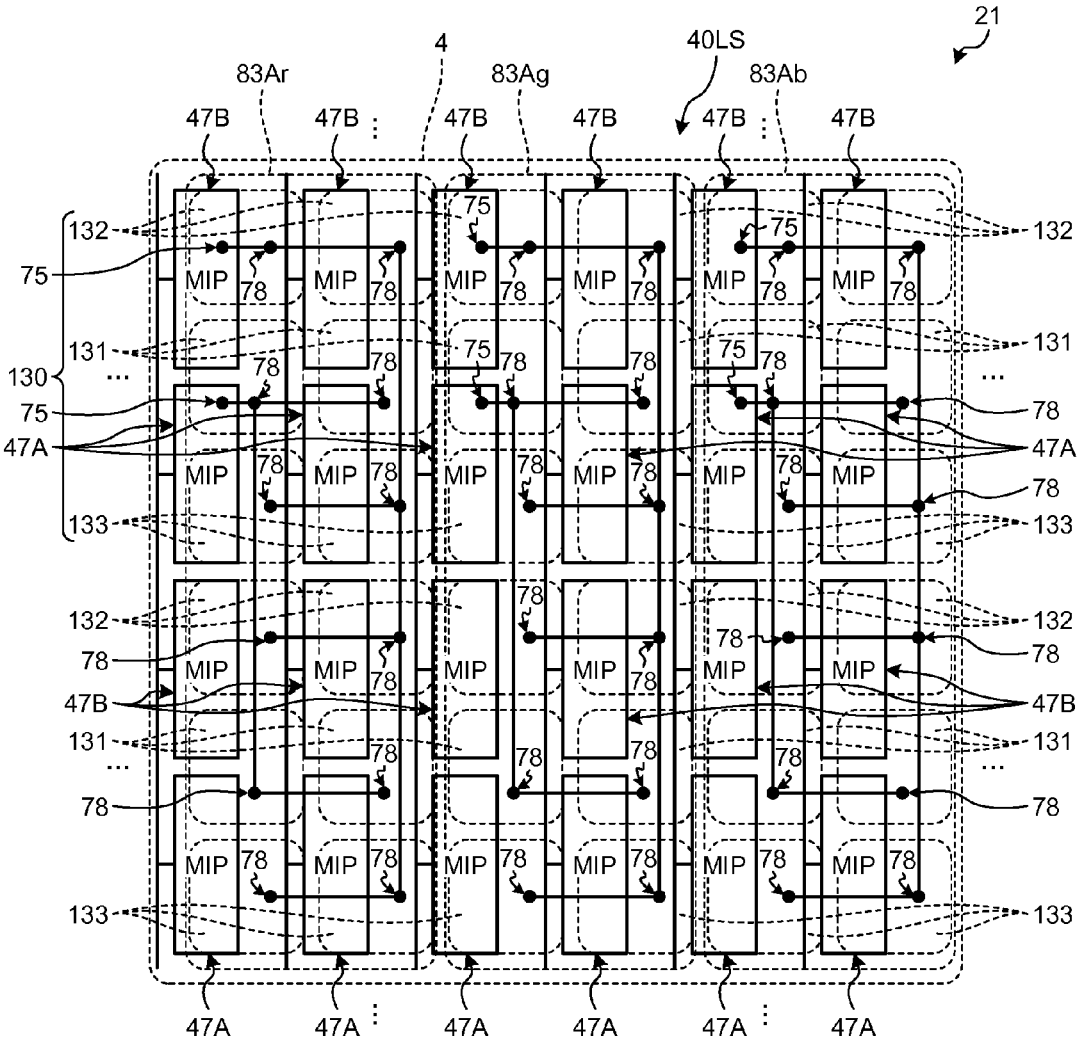
FIG. 18 is a diagram illustrating an example of a display panel in which drive electrodes and pixel electrodes are arranged.

FIG. 18 is a diagram illustrating an example of the display panel in which the drive electrodes and the pixel electrodes are arranged. As illustrated in FIG. 18, in the pixel 4, the sub-pixel electrodes 130 including the three partial electrodes 132, 131, and 133 are arranged in a line. A red color filter 83Ar, a green color filter 83Ag, and a blue color filter 83Ab for performing color separation into the three primary colors of red, green, and blue in the CF layer 83 are arranged corresponding to each of the 2 rows by 2 columns of sub-pixel electrodes 130. In a region occupied by the pixel 4, memory circuits of which number is equal to the number of pixel electrodes included in the sub-pixel electrode 130 are arranged at different lamination positions corresponding to the partial electrodes 132, 131, and 133.

With respect to the pixel array unit 21, the arrangement of the partial electrodes 131, 132, and 133 is the same in the low-resolution region 40LS illustrated in FIG. 18 and in the pixel 4 in the color full-spec region 40FU illustrated in FIG. 10, whereas the area occupied by the pixel 4 is four times larger in FIG. 18 than in FIG. 10. In addition, in the pixel array unit 21, the number of the memory circuits 47A and 47B arranged for each sub-pixel electrode 130 in the low-resolution region 40LS is equal to the number of the memory circuits 47A and 47B in the color full-spec region 40FU.

As illustrated in FIG. 18, the memory circuits 47A and 47B are connected to the partial electrodes 131, and the partial electrodes 132 and 133, respectively. The memory circuit 47A drives the 2 rows by 2 columns of four partial electrodes 131 at the same time, and the memory circuit 47B drives the 2 rows by 2 columns of four partial electrodes 132 and four partial electrodes 133 at the same time. As described above, the sub-pixel electrode 130 includes two pixel electrodes and is driven by the memory circuits of which number is equal to the number of the pixel electrodes. The 2 rows by 2 columns of the partial electrodes 132, 131, and 133 of the sub-pixel electrode 130 are driven by one pair of memory circuits 47A and 47B, and are not connected to the other three pairs.

As described above, the sub-pixel electrode 130 includes the partial electrodes 132, 131, and 133, and the memory circuits 47A and 47B are arranged corresponding to the partial electrodes 132, 131, and 133. The numbers of the memory circuits arranged corresponding to the sub-pixel electrode 130 are the same between one region (a first region) and another region (a second region) among the color full-spec region 40FU, the monochrome region 40MC, the inactive region 40IV, and the low-resolution region 40LS of which resolution is low. When the first region is the color full-spec region 40FU, the second region may be any of the monochrome region 40MC, the inactive region 40IV, and the low-resolution region 40LS. The number of the memory circuits 47A and 47B arranged corresponding to the sub-pixel electrode 130 is the number of the memory circuits in a region that can display the maximum number of gradations. Therefore, even when the layout is changed to the layout having a region with a different number of displayable gradations, the display panel 2 can optionally and easily change the configuration and range of the region where at least one of the numbers of displayable gradations and the maximum resolution are different, by changing connection state between the sub-pixel electrode 130 and the memory circuits 47A and 47B.

2. Application Example

Figure 19:
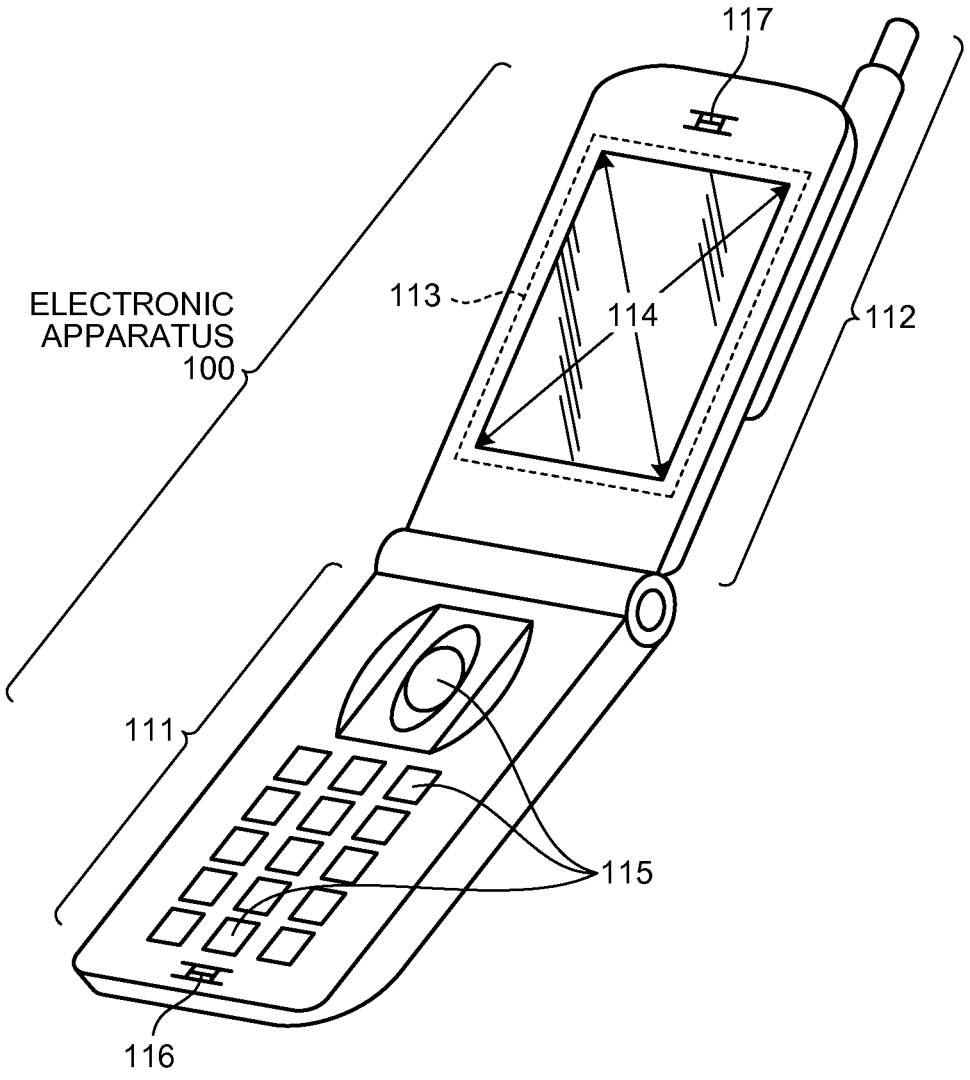
FIG. 19 is a perspective view illustrating an example of the configuration of electronic apparatus according to an application example.

An application example of the display device 1 according to the above-described embodiments and the modification thereof will be described. FIG. 19 is a perspective view illustrating an example of the schematic configuration of electronic apparatus 100 according to the present application example. The electronic apparatus 100 is a cellular telephone and, for example, as illustrated in FIG. 19, includes a body part 111 and a display part 112 openable/closable with respect to the body part 111. The body part 111 includes operation buttons 115 and a transmitter unit 116. The display part 112 includes a display device 113 and a receiver unit 117. The display device 113 displays various indications about telephone communication on a display screen 114 of the display device 113. The electronic apparatus 100 includes a control unit (not illustrated) for controlling operation of the display device 113. The control unit is provided inside the body part 111 or the display part 112, as part of or separately from a control unit that governs control of the entire electronic apparatus 100.

The display device 113 has the same configuration as that of the display device 1 according to the above-described embodiments and the modification thereof. Accordingly, the display device 113 achieves low power consumption while suppressing generation of a flicker.

Examples of the electronic apparatus to which the display device 1 according to the above-described embodiments and the modification thereof may be applied include, but are not limited to, personal computers, liquid crystal televisions, viewfinder type or a direct-view monitor type video cam recorders, car navigation systems, pagers, electronic organizers, electronic calculators, word processors, workstations, videophones, POS terminal devices, etc. in addition to cellular telephones as described above.

In the display device and the electronic apparatus according to the present disclosure, the risk of enhancing edges of a plurality of regions is reduced even if at least one of the maximum number of gradations and the maximum resolution is different between the regions. Consequently, at least one of the maximum number of displayable gradations and pixel resolution can differ between regions of a display panel.

According to one aspect of the display device and the electronic apparatus of the present disclosure, at least one of the maximum number of displayable gradations and pixel resolution may differ between regions of a display panel, thereby achieving low power consumption.

It should be understood that various changes and modifications to the presently preferred embodiments described herein will be apparent to those skilled in the art. Such changes and modifications can be made without departing from the spirit and scope of the present subject matter and without diminishing its intended advantages. It is therefore intended that such changes and modifications be covered by the appended claims.

The invention is claimed as follows:

1. A display device comprising:

a display panel including pixels each including sub-pixel electrodes arranged in a matrix, the display panel being divided into display panel regions including at least:

a first region in which a predeteremined maximum number of displayable gradations is largest among the display panel regions; and a second region in which the predeteremined maximum number of displayable gradations is smaller than the first region; and memory circuits located under the sub-pixel electrodes, each of memory circuits storing therein pixel potential corresponding to gradation to be applied to at least one of the sub-pixel electrodes, wherein;

the arrangement of the sub-pixel electrodes is the same in the first region and the second region of the display panel;

each of the sub-pixel electrodes includes partial electrodes;

the memory circuits are arranged corresponding to the partial electrodes;

at least one of the memory circuits is arranged to correspond to the sub-pixel electrodes in the first region with a same number as the second region;

in the second region, some of the memory circuits are not connected to the sub-pixel electrodes; and a number of connections from at least one of the memory circuits to the partial electrodes in the second region is smaller than a number of connections from at least one of the memory circuits to the partial electrodes in the first region.

2. The display device according to claim 1, wherein the sub-pixel electrodes reflect ambient light entering from a surface of the display panel.

3. The display device according to claim 1, wherein a number of the memory circuits in the second region is a same number of the memory circuits in the first region capable of displaying the maximum number of gradations among the display panel regions.

4. The display device according to claim 1, wherein each of the sub-pixel electrodes has three partial electrodes, two of the memory circuits including a first memory circuit and a second memory circuit are arranged corresponding to the three partial electrodes including a first partial electrode, a second partial electrode, and a third partial electrode.

5. The display device according to claim 4, wherein in each of the sub-pixel electrodes, three partial electrodes having a same area are arranged in a line for the pixel, and the first partial electrode and the third partial electrode are electrically connected via a relay wiring layer.

6. The display device according to claim 5, wherein in each of the sub-pixels, the first memory circuit is connected to the first partial electrode and third partial electrode, and the second memory circuit is connected to the second partial electrode.

7. The display device according to claim 6, wherein in each of the sub-pixels, the first memory circuit is connected to the first partial electrode through a contact portion in a center of the first partial electrode and is connected to third partial electrode through contact portion in a center of the third partial electrode.

8. The display device according to claim 7, wherein the sub-pixel electrodes are arranged on an insulating layer, where the contact portion is formed.

9. An electronic apparatus having a display device, the display device comprising:

a display panel including pixels each including sub-pixel electrodes arranged in a matrix, the display panel being divided into display panel regions including at least;

a first region in which a predetermined maximum number of displayable gradation is largest among the display panel regions; and a second region in which the predetermined maximum number of displayable gradation is smaller than the first region; and memory circuits located under the sub-pixel electrodes, each of memory circuits storing therein pixel potential corresponding to gradation to be applied to at least one of the sub-pixel electrodes, wherein;

the arrangement of the sub-pixel electrodes is the same in the first region and the second region of the display panel;

each of the sub-pixel electrodes includes partial electrodes;

the memory circuits are arranged corresponding to the partial electrodes;

at least one of the memory circuits is arranged to correspond to the sub-pixel electrodes in the first region with a same number as the second region;

in the second region, some of the memory circuits are not connected to the sub-pixel electrodes; and a number of connections from at least one of the memory circuits to the partial electrodes in the second region is smaller than a number of connections from at least one of the memory circuits to the partial electrodes in the first region.

* * * * *